US006132949A

United States Patent [19]

Fujita et al.

[11] Patent Number: 6,132,949

[45] Date of Patent: Oct. 17, 2000

[54] PHOTOTHERMOGRAPHIC MATERIAL

[75] Inventors: Munehisa Fujita; Tatsuya Ishizaka; Akira Hatakeyama; Hisashi Okada; Naoki Asanuma, all of Kanagawa, Japan

[73] Assignee: Fuji Photo Film Co., Ltd., Kanagawa, Japan

[21] Appl. No.: 08/996,255

[22] Filed: Dec. 22, 1997

[30] Foreign Application Priority Data

| | | | |
|---|---|---|---|
| Dec. 25, 1996 | [JP] | Japan | 8-355980 |
| Dec. 25, 1996 | [JP] | Japan | 8-355981 |
| Dec. 26, 1996 | [JP] | Japan | 8-357349 |
| Dec. 27, 1996 | [JP] | Japan | 8-357889 |
| Dec. 27, 1996 | [JP] | Japan | 8-357890 |
| Feb. 5, 1997 | [JP] | Japan | 9-037092 |

[51] Int. Cl.[7] ..... G03C 1/498

[52] U.S. Cl. ..... 430/619; 430/523; 430/531; 430/607; 430/965

[58] Field of Search ..... 430/619, 531, 430/523, 950, 965, 618, 546, 607

[56] References Cited

U.S. PATENT DOCUMENTS

| | | | |
|---|---|---|---|
| 3,152,904 | 10/1964 | Sorensen et al. . | |
| 3,457,075 | 7/1969 | Morgan et al. . | |
| 3,785,830 | 1/1974 | Sullivan et al. . | |
| 4,123,274 | 10/1978 | Knight et al. . | |
| 4,201,582 | 5/1980 | White . | |
| 4,213,784 | 7/1980 | Ikenoue et al. | 430/616 |
| 4,504,575 | 3/1985 | Lee . | |
| 4,529,689 | 7/1985 | Lee . | |
| 4,848,020 | 7/1989 | Itoh et al. | 430/445 |
| 5,677,121 | 10/1997 | Tsuzuki . | |
| 5,698,380 | 12/1997 | Toya | 430/363 |
| 5,723,273 | 3/1998 | Anderson et al. | 430/527 |
| 5,750,328 | 5/1998 | Melpolder et al. | 430/619 |

FOREIGN PATENT DOCUMENTS

| | | |
|---|---|---|
| 49-52626 | 5/1974 | Japan . |
| 50-151138 | 12/1975 | Japan . |
| 53-116144 | 10/1978 | Japan . |
| 58-28737 | 2/1983 | Japan . |
| 60-61747 | 4/1985 | Japan . |
| WO 97/04355 | 2/1997 | WIPO . |
| WO 97/04356 | 2/1997 | WIPO . |

*Primary Examiner*—Thorl Chea
*Attorney, Agent, or Firm*—Birch, Stewart, Kolasch & Birch, LLP

[57] ABSTRACT

The invention provides a photothermographic material comprising a photosensitive silver halide, an organic silver salt, a reducing agent, and a binder on a support. A layer containing the organic silver salt has been formed by using a solid particle dispersion of the organic silver salt and a polymer latex as a main binder, preparing a coating solution of the salt and the binder in an aqueous solvent, and coating the solution, followed by drying. Coating operation is easy, and coating surface quality and photographic properties are improved.

20 Claims, No Drawings

PHOTOTHERMOGRAPHIC MATERIAL

This invention relates to a photothermographic material and more particularly, to a photosensitive material for use in laser image setters and laser imagers, to be simply referred to as LI photosensitive material, hereinafter. It further relates to a photothermographic material inclusive of an LI photosensitive material which can produce a very sharp image of quality having improved graininess and thus faithfully reproduce image information. It further relates to a photothermographic material which has a photosensitive layer formed using an aqueous coating solution and is improved in coating surface quality, silver tone and photographic properties.

BACKGROUND OF THE INVENTION

There are known a number of photosensitive materials comprising a photosensitive layer on a support wherein images are formed by imagewise exposure. Among these, a technique of forming images through heat development is known as a system capable of simplifying image forming means and contributing to the environmental protection.

From the contemporary standpoints of environmental protection and space saving, it is strongly desired in the medical imaging field to reduce the quantity of spent solution. Needed in this regard is a technology relating to thermographic photosensitive materials for use in medical diagnosis and general photography which can be effectively exposed by means of laser image setters and laser imagers and produce distinct black images having high resolution and sharpness. These thermographic photosensitive materials offer to the customer a simple thermographic system which eliminates a need for solution type chemical agents and is not detrimental to the environment.

Photothermographic materials which are processed by a photothermographic process to form photographic images are disclosed, for example, in U.S. Pat. Nos. 3,152,904 and 3,457,075, D. Morgan and B. Shely, "Thermally Processed Silver Systems" in "Imaging Processes and Materials," Neblette, 8th Ed., Sturge, V. Walworth and A. Shepp Ed., page 2, 1969. These photothermographic materials generally contain a reducible silver source (e.g., organic silver salt), a catalytic amount of a photocatalyst (e.g., silver halide), and a reducing agent, typically dispersed in a binder matrix. Photothermographic materials are stable at room temperature. When they are heated at an elevated temperature (e.g., 80° C. or higher) after exposure, redox reaction takes place between the reducible silver source (functioning as an oxidizing agent) and the reducing agent to form silver. This redox reaction is promoted by the catalysis of a latent image produced by exposure. Silver formed by reaction of the reducible silver salt in exposed regions provides black images in contrast to unexposed regions, eventually forming an image.

Photothermographic materials of this type are well known and most of them have a photosensitive layer which is formed by coating a coating solution in an organic solvent such as toluene, methyl ethyl ketone and methanol. The use of organic solvents is hazardous to workers involved in the manufacturing process and disadvantageous because of an extra cost for solvent recovery.

It was devised to form a photosensitive layer using a coating solution of water solvent (sometimes referred to as aqueous photosensitive layer) without such concern. For example, JP-A 52626/1974 and 116144/1978 disclose the use of gelatin as a binder. JP-A 151138/1975 discloses the use of polyvinyl alcohol as a binder. JP-A 61747/1985 discloses the combined use of gelatin and polyvinyl alcohol. JP-A 28737/1983 discloses a photosensitive layer containing water-soluble polyvinyl acetal as a binder.

The use of these binders leads to environmental and economical benefits because a photosensitive layer can be formed using a coating solution in water solvent.

The use of gelatin, polyvinyl alcohol, polyacetal and other water-soluble polymers as the binder, however, results in photosensitive materials which are of extremely low commodity worth in that a coating whose surface quality is practically acceptable is not available since these polymers are less compatible with the organic silver salt, that the silver tone of developed areas becomes brown or yellow and far from the essentially favorable black and that exposed areas have a low blackened density and unexposed areas have a high density.

There is a desire to develop a photothermographic material or aqueous photosensitive material having environmental and economic benefits, good coating surface quality, acceptable silver tone and satisfactory photographic properties upon development.

SUMMARY OF THE INVENTION

A primary object of the present invention is to provide a novel and improved photothermographic material having an organic silver salt-containing layer, typically a photosensitive layer, formed by coating a coating solution of an aqueous solvent having environmental and economic benefits, and offering good coating surface quality, acceptable silver tone and satisfactory photographic properties upon development.

Another object of the present invention is to provide a photothermographic material which is improved in photographic properties, natural aging stability, and surface quality by using an easy-to-handle coating solution of photosensitive components.

A further object of the present invention is to provide a photothermographic material which is improved in surface quality and photographic properties.

A yet further object of the present invention is to provide a photothermographic material which is improved in surface quality, photographic properties and water resistance.

A still further object of the present invention is to provide a photothermographic material which prevents a matte agent from deteriorating upon heat development at elevated temperature and gives a good feel to hand touch.

A still further object of the present invention is to provide a photothermographic material which can be prepared from easy-to-handle photosensitive components, is improved in photographic properties, natural aging stability, surface quality and silver tone.

The present invention provides a photothermographic material comprising at least a photosensitive silver halide, an organic silver salt, a reducing agent, and a binder on a support. The organic silver salt is in the form of solid microparticulates having a mean particle size of 0.05 to 10.0 $\mu$m. A layer contains the organic silver salt in a binder which contains at least 50% by weight of a polymer originating from a polymer latex.

Preferably, the layer containing the organic silver salt has been formed by coating a coating solution of the organic silver salt in a solvent containing at least 30% by weight of water, followed by drying. Preferably, the solvent of the coating solution contains at least 70% by weight of water.

Preferably, the polymer has an equilibrium moisture content of up to 2% by weight at 25° C. and RH 60%. The organic silver salt is typically a silver salt of an organic acid.

In one preferred embodiment, a layer containing the reducing agent has been formed using a solid particle dispersion of the reducing agent and a polymer latex as a main binder. More preferably, the layer containing the reducing agent has been formed by coating a coating solution of the reducing agent in a solvent containing at least 30% by weight of water, followed by drying.

In another preferred embodiment wherein the photothermographic material further contains a toner, a layer containing the toner has been formed using a solid particle dispersion of the toner and a polymer latex as a main binder. Where at least two toners are used, a layer containing the at least two toners has been formed using a solid particle dispersion prepared by simultaneously dispersing the at least two toners.

In a further preferred embodiment wherein the photothermographic material further contains an antifoggant, a layer containing the antifoggant has been formed using a solid particle dispersion of the antifoggant and a polymer latex. More preferably, the layer containing the antifoggant has been formed by coating a coating solution of the antifoggant in a solvent containing at least 30% by weight of water, followed by drying. Also preferably, the antifoggant in solid microparticulate form and the photosensitive silver halide are contained in a common layer.

In a still further preferred embodiment, the photothermographic material further includes a surface protective layer which has been crosslinked with a crosslinking agent.

In a still further preferred embodiment, the photothermographic material includes a photosensitive layer containing the photosensitive silver halide, a surface protective layer, and at least one non-photosensitive layer between the photosensitive layer and the surface protective layer on at least one surface of the support. The photosensitive layer containing the photosensitive silver halide has been formed by using a polymer latex as a binder in an amount to account for at least 50% by weight of the binder, coating a coating solution of the binder dispersed in a solvent containing at least 30% by weight of water, and drying the coating. More preferably, the non-photosensizive layer has been formed using a polymer latex or hydrophilic polymer as a binder in an amount to account for at least 50% by weight of the binder. More preferably, the surface protective layer contains a binder composed of at least 30% by weight of a hydrophilic polymer which is typically gelatin.

In a still further preferred embodiment, the photothermographic material further includes at least one layer containing a matte agent of spherical silica on at least one surface of the support.

DESCRIPTION OF THE PREFERRED EMBODIMENTS

The photothermographic material of the invention contains at least a photosensitive silver halide, an organic silver salt, a reducing agent, and a binder on a support. A layer containing the organic silver salt is formed by using the organic silver salt in the form of solid microparticulates having a mean particle size of 0.05 to 10.0 μm and a polymer latex as a binder, forming a dispersion of the organic silver salt and the polymer latex, and coating the dispersion. A polymer originating from the polymer latex should constitute at least 50% by weight of the binder.

By using the organic silver salt in the form of a dispersion of solid microparticulates having a mean particle size of 0.05 to 10.0 μm and restricting the polymer (latex) content of the binder in the organic silver salt-containing layer to at least 50%, a photothermographic material having improved coating surface quality and silver tone is obtained. Organic silver salt particles with a mean particle size in excess of 10.0 μm exacerbate coating surface quality whereas it is impractical to reduce the mean particle size of solid microparticulates to less than 0.05 μm. If the polymer of the polymer latex is less than 50% by weight of the binder, silver tone is exacerbated.

The "polymer latex" is a dispersion of a microparticulate water-insoluble hydrophobic polymer in a water-soluble dispersing medium. With respect to the dispersed state, a polymer emulsified in a dispersing medium, an emulsion polymerized polymer, a micelle dispersion, and a polymer having a hydrophilic structure in a part of its molecule so that the molecular chain itself is dispersed on a molecular basis are included. With respect to the polymer latex, reference is made to Okuda and Inagaki Ed., "Synthetic Resin Emulsion," Kobunshi Kankokai, 1978; Sugimura, Kataoka, Suzuki and Kasahara Ed., "Application of Synthetic Latex," Kobunshi Kankokai, 1993; and Muroi, "Chemistry of Synthetic Latex," Kobunshi Kankokai, 1970. Dispersed particles in the polymer latex should preferably have a mean particle size of about 1 to 50,000 nm, more preferably about 5 to 1,000 nm. The particle size distribution of dispersed particles is not critical.

Polymers used in the polymer latex according to the invention include acryl resins, vinyl acetate resins, polyester resins, polyurethane resins, rubbery resins, vinyl chloride resins, vinylidene chloride resins, and polyolefin resins. The polymers used herein may be linear, branched or crosslinked ones. The polymer may be either a homopolymer having a single monomer polymerized or a copolymer having tow or more monomers polymerized. The copolymer may be either a random copolymer or a block copolymer. The polymer should preferably have a number average molecular weight (Mn) of about 5,000 to 1,000,000, more preferably about 10,000 to 200,000. Outside this range, a polymer with a lower molecular weight would provide the organic silver salt-containing layer with insufficient mechanical strength whereas a polymer with a higher molecular weight would be less adapted to film formation.

The polymer of the polymer latex used herein should preferably have an equilibrium moisture content of up to 2% by weight, more preferably up to 1% by weight at 25° C. and RH 60%. The lower limit of equilibrium moisture content is not critical although it is preferably 0.01% by weight, more preferably 0.03% by weight. With respect to the definition and measurement of an equilibrium moisture content, reference is made to Kobunshi Gakkai Ed., "Polymer Engineering Series 14—Polymeric Material Tests," Chijin Shokan K.K. The equilibrium moisture content (Weq) of a polymer at 25° C. and RH 60% is calculated according to the following expression:

$$Weq=(W1-W0)/W0\times 100\%$$

using the weight (W1) of the polymer conditioned in an atmosphere of 25° C. and RH 60% until equilibrium is reached and the weight (W0) of the polymer in an absolute dry condition at 25° C. Actual measurement will be described later in Examples.

Illustrative preferred examples of the polymer latex are given below as P-1 to P-7 wherein numerical values are % by weight and Mn is a number average molecular weight.

Designation Units Mn

P-1 -$MMA_{70}$-$EA_{27}$-$MAA_{3}$- latex 37,000

P-2 -$MMA_{70}$-$2EHA_{20}$-$St_5$-$AA_5$- latex 40, 000
P-3 -$St_{70}$-$Bu_{25}$-$AA_5$- latex 60,000
P-4 -$St_{60}$-$Bu_{35}$-$DVB_3$-$MAA_2$- latex 150,000
P-5 -$VC_{50}$-$MMA_{20}$-$EA_{20}$ -$AN_5$-$AA_5$- latex 80,000
P-6 -$VDC_{85}$-$MMA_5$-$EA_5$-$MAA_5$- latex 67,000
P-7 -$Et_{90}$-$MAA_{10}$- latex 12,000

MMA: methyl methacrylate

EA: ethyl acrylate

MAA: methacrylic acid

2EHA: 2-ethylhexyl acrylate

St: styrene

Bu: butadiene

AA: acrylic acid

DVB: divinyl benzene

VC: vinyl chloride

AN: acrylonitrile

VDC: vinylidene chloride

Et: ethylene

These polymers are commercially available. Useful examples of the polymer latex which can be used herein include acrylic resins such as Sebian A-4635, 46583 and 4601 (Daicell Chemical K.K.) and Nipol Lx811, 814, 821, 820 and 857 (Nippon Zeon K.K.); polyester resins such as FINETEX ES650, 611, 675 and 850 (Dai-Nihon Ink Chemical K.K.) and WD-size and WMS (Eastman Chemical Products, Inc.); polyurethane resins such as HYDRAN AP10, 20, 30 and 40 (Dai-Nihon Ink Chemical K.K.); rubbery resins such as LACSTAR 7310K, 3307B, 4700H and 7132C (Dai-Nihon Ink Chemical K.K.) and Nipol Lx416, 410, 438C and 2507 (Nippon Zeon K.K.); vinyl chloride resins such as G351 and G576 (Nippon Zeon K.K.); vinylidene chloride resins such as L502 and L513 (Asahi Chemicals K.K.); and olefin resins such as Chemipearl S120 and SA100 (Mitsui Petro-Chemical K.K.)

These polymers may be used in polymer latex form alone or in admixture of two or more.

The polymer latex used herein is preferably a latex of a styrene-butadiene copolymer. The styrene-butadiene copolymer preferably contains styrene monomer units and butadiene monomer units in a weight ratio of from 40:60 to 95:5. Also preferably the styrene-butadiene copolymer contains 60 to 99% by weight of styrene and butadiene monomer units combined. The preferred molecular weight range is as previously described.

Preferred examples of the styrene-butadiene copolymer latex which is used herein are P-3, P-4, LACSTAR 3307B and 7132C, and Nipol Lx416.

In the organic silver salt-containing layer according to the invention, the polymer originating from the polymer latex should constitute at least 50%, preferably at least 70% by weight of the entire binder.

A hydrophilic polymer may be added to the organic silver salt-containing layer in an amount of up to 50%, preferably less than 50% by weight of the entire binder. Such hydrophilic polymers include gelatin, polyvinyl alcohol, methyl cellulose, hydroxypropyl cellulose, carboxymethyl cellulose, and hydroxypropyumethyl cellulose. The amount of the hydrophilic polymer added is more preferably up to 30%, further preferably less than 30%, especially up to 20% by weight of the entire binder in the photosensitive layer.

The use of a polymer latex as defined above enables to form the organic silver salt-containing layer using a coating solution in an aqueous solvent containing at least 30% by weight of water, which has environmental and economical benefits as compared with organic solvents. The polymer latex is preferably used in combination with an aqueous solvent whereby an improved coating surface is obtained.

The "aqueous" solvent in which the polymer is dissolvable or dispersible is water or a mixture of water and up to 70%, preferably less than 70% by weight of a water-miscible organic solvent. Examples of the water-miscible organic solvent include alcohols such as methanol, ethanol, and propanol, cellosolves such as methyl cellosolve, ethyl cellosolve, and butyl cellosolve, and ethyl acetate and dimethylformamide. The term "aqueous solvent" is also applied to a system wherein a polymer is not thermodynamically dissolved, but dispersed.

The solvent of the coating solution from which the organic silver salt-containing layer of the photosensitive material according to the invention is formed (for simplicity's sake, the term solvent is used as a mixture of a solvent and a dispersing medium) is an aqueous solvent containing at least 30%, preferably more than 30% by weight of water. The component other than water may be any of water-miscible organic solvents such as methyl alcohol, ethyl alcohol, isopropyl alcohol, methyl cellosolve, ethyl cellosolve, ethyl acetate and dimethylformamide. The solvent of the coating solution should more preferably contain at least 50%, further preferably at least 70% by weight of water. Exemplary solvent mixtures are a 90/10 or 70/30 mixture of water/methyl alcohol, a 80/15/5 mixture of water/methyl alcohol/dimethylformamide, a 85/10/5 mixture of water/methyl alcohol/ethyl cellosolve, and a 85/10/5 mixture of water/methyl alcohol/isopropyl alcohol, all expressed in a weight ratio.

As mentioned above, the organic silver salt-containing layer according to the invention is formed using a solid particle dispersion of an organic silver salt and a polymer latex. The amount of the binder in the organic silver salt-containing layer is such that the weight ratio of the entire binder to the organic silver salt may range from 1/10 to 10/1, more preferably from 1/5 to 4/1.

Most often, the organic silver salt-containing layer is also a photosensitive layer (or emulsion layer) containing a photosensitive silver salt, typically photosensitive silver halide. In this embodiment, the weight ratio of the entire binder to the silver halide is preferably from 400/1 to 5/1, more preferably 200/1 to 10/1.

According to the invention, the photothermographic material contains a photosensitive silver halide as a photosensitive silver salt, an organic silver salt, a reducing agent, and a binder on a support. Most often, the photosensitive silver halide and the organic silver salt are contained in a common layer. That is, it is preferred that the organic silver salt-containing layer is also a photosensitive layer. Further preferably, the reducing agent is contained in the same layer.

One or more organic silver salt-containing layers may be provided in the photothermographic material of the invention. When two or more layers are provided, they may be on one side or both sides of the support. Where there are two or more organic silver salt-containing layers, at least one layer, preferably all the layers should be formed by using a solid particle dispersion of the organic silver salt and a polymer latex as defined herein and preferably coating a coating solution of them in an aqueous solvent.

The organic silver salt-containing layer also serving as a photosensitive layer according to the invention should preferably have a thickness of 0.2 to 30 $\mu$m, more preferably 1 to 20 $\mu$m for each.

The organic silver salt-containing layer is formed using a coating solution which contains components corresponding to the composition of the organic silver salt-containing layer and a coating solvent, preferably an aqueous solvent. The ratio of the components (solids) to the aqueous solvent in the coating solution is usually from about 1/99 to about 40/60 in weight ratio. After application, the coating is dried at about 30 to 200° C. for about ½ to 30 minutes. The organic silver salt-containing layer may be coated separately from other layers such as a surface protective layer or simultaneously in an overlapping manner. Such two or more coatings may be simultaneously dried. Prior to drying, the coatings may be kept at a temperature of about 0° C. to about 200° C. for about 5 seconds to about 10 minutes.

In the practice of the invention, not only the organic silver salt-containing layer (typically also serving as a photosensitive layer), but all constituent layers (including a photosensitive layer, a surface protective layer, and a back layer) of the photosensitive material are formed using coating solutions of effective components in aqueous solvents as a coating solvent. The aqueous solvent should have a water content of at least 30% by weight, preferably more than 30% by weight, more preferably at least 50% by weight, most preferably at least 70% by weight. The use of such an aqueous solvent leads to environmental and economical benefits.

Coating surface quality is significantly improved when an organic silver salt-containing layer is formed using an aqueous solvent containing at least 70% by weight of water.

Organic Silver Salt

The organic silver salt used herein should take the form of solid microparticulates, preferably substantially spherical solid microparticulates, having a mean particle size of 0.05 to 10.0 μm. The organic silver salt is used as a dispersion. Preferably the solid microparticulates have a mean particle size of 0.1 to 5.0 μm, especially 0.1 to 2.0 μm. The mean particle size may be determined by irradiating laser light, for example, to a solid particle dispersion in a liquid and determining the autocorrelation function of the fluctuation of scattering light relative to a time change, and obtaining the particle size (volume weighed mean diameter) therefrom.

The particle size distribution of the organic silver salt is desirably monodisperse. Specifically, a coefficient of variation of volume weighed mean diameter is preferably up to 80%, more preferably up to 50%, most preferably up to 30%. The shape of organic silver salt may be determined from a transmission electron microscope image of the organic silver salt dispersion.

In order that microparticulates be free of flocculation, the organic silver salt is prepared into a solid microparticulate dispersion using a dispersant. A solid microparticulate dispersion of the organic silver salt may be prepared by mechanically dispersing the salt in the presence of a dispersant by well-known comminuting means such as ball mills, vibrating ball mills, planetary ball mills, sand mills, colloidal mills, jet mills, and roller mills.

The dispersant used in the preparation of a solid microparticulate dispersion of the organic silver salt may be selected from synthetic anionic polymers such as polyacrylic acid, copolymers of acrylic acid, copolymers of maleic acid, copolymers of maleic acid monoester, and copolymers of acryloyumethylpropanesulfonic acid; semi-synthetic anionic polymers such as carboxymethyl starch and carboxymethyl cellulose; anionic polymers such as alginic acid and pectic acid; anionic surfactants as described in JP-A 92716/1977 and WO 88/04794; the compounds described in Japanese Patent Application No. 350753/1995; well-known anionic, nonionic and cationic surfactants; and well-known polymers such as polyvinyl alcohol, polyvinyl pyrrolidone, carboxymethyl cellulose, hydroxypropyl cellulose, and hydroxypropyumethyl cellulose, as well as naturally occurring high molecular weight compounds such as gelatin.

In general, the dispersant is mixed with the organic silver salt in powder or wet cake form prior to dispersion. The resulting slurry is fed into a dispersing machine. Alternatively, a mixture of the dispersant with the organic silver salt is subject to heat treatment or solvent treatment to form a dispersant-bearing powder or wet cake of the organic silver salt. It is acceptable to effect pH control with a suitable pH adjusting agent before, during or after dispersion.

Rather than mechanical dispersion, fine particles can be formed by roughly dispersing the organic silver salt in a solvent through pH control and thereafter, changing the pH in the presence of dispersants. An organic solvent can be used as the solvent for rough dispersion although the organic solvent is usually removed at the end of formation of fine particles.

The thus prepared dispersion may be stored while continuously stirring for the purpose of preventing fine particles from settling during storage. Alternatively, the dispersion is stored after adding hydrophilic colloid to establish a highly viscous state (for example, in a jelly-like state using gelatin). An antiseptic agent may be added to the dispersion in order to prevent the growth of bacteria during storage.

The organic silver salt used herein is relatively stable to light, but forms a silver image when heated at 80° C. or higher in the presence of an exposed photocatalyst (as typified by a latent image of photosensitive silver halide) and a reducing agent. The organic silver salt may be of any desired organic compound containing a source capable of reducing silver ion. Preferred are silver salts of organic acids, typically long chain aliphatic carboxylic acids having 10 to 30 carbon atoms, especially 15 to 28 carbon atoms. Also preferred are complexes of organic or inorganic silver salts with ligands having a stability constant in the range of 4.0 to 10.0. The organic silver salt preferably constitutes about 5 to 30% by weight of the organic silver salt-containing layer. Specifically, the organic silver salt is preferably used in an amount of 0.1 to 50 g/m$^2$, more preferably 1 to 30 g/m$^2$. Preferred organic silver salts include silver salts of organic compounds having a carboxyl group. Examples include silver salts of aliphatic carboxylic acids and silver salts of aromatic carboxylic acids though not limited thereto. Preferred examples of the silver salt of aliphatic carboxylic acid include silver behenate, silver stearate, silver oleate, silver laurate, silver caproate, silver myristate, silver paumitate, silver maleate, silver fumarate, silver tartrate, silver linolate, silver butyrate, silver camphorate and mixtures thereof.

Silver salts of compounds having a mercapto or thion group and derivatives thereof are also useful. Preferred examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-(ethylglycolamido)-benzothiazole, silver salts of thioglycolic acids such as silver salts of S-alkylthioglycolic acids wherein the alkyl group has 12 to 22 carbon atoms, silver salts of dithiocarboxylic acids such as a silver salt of dithioacetic acid, silver salts of thioamides, a silver salt of 5-carboxyl-1-methyl-2-phenyl-4-thiopyridine, silver salts of mercapto-triazines, a silver salt of 2-mercaptobenzoxazole as well as silver salts of 1,2,4-mercaptothiazole derivatives such as a silver salt of 3-amino-5-benzylthio-1,2,4-thiazole as described in U.S. Pat. No. 4,123,274 and silver salts of thion compounds such as a silver salt of 3-(3-carboxyethyl)-4-methyl-4-thiazoline-2-thion as described in U.S. Pat. No. 3,301,678. Compounds containing an imino group may also be used. Preferred examples of these compounds include silver salts of benzotriazole and derivatives thereof, for example, silver salts of benzotriazoles such as silver methylbenzotriazole, silver salts of halogenated benzotriazoles such as silver 5-chlorobenzotriazole as well as silver sales of 1,2,4-triazole and 1-H-tetrazole and silver salts of imidazole and imidazole derivatives as described in U.S. Pat. No. 4,220,709. Also useful are various silver acetylide compounds as described, for example, in U.S. Pat. Nos. 4,761,361 and 4,775,613.

The organic silver salt used herein is preferably desalted. The desalting method is not critical. Any well-known method may be used although well-known filtration methods such as centrifugation, suction filtration, and ultrafiltration are preferred.

Silver Halide

A method for forming a photosensitive silver halide is well known in the art. Any of the methods disclosed in Research Disclosure No. 17029 (June 1978) and U.S. Pat. No. 3,700,458, for example, may be used. Illustrative methods which can be used herein are a method of adding a halogen-containing compound to a pre-formed organic silpart alt to convert a part of silver of the organic silver salt into photosensitive silver halide and a method of adding a silver-providing compound and a halogen-providing compound to a solution of gelatin or another polymer to form photosensitive silver halide grains and mixing the grains with an organic silver salt. The latter method is preferred in the practice of the invention. The photosensitive silver halide should preferably have a smaller grain size for the purpose of minimizing white turbidity after image formation. Specifically, the grain size is up to 0.20 $\mu$m, preferably 0.01 $\mu$m to 0.15 $\mu$m, most preferably 0.02 $\mu$m to 0.12 $\mu$m. The term grain size designates the length of an edge of a silver halide grain where silver halide grains are regular grains of cubic or octahedral shape. Where silver halide grains are tabular, the grain size is the diameter of an equivalent circle having the same area as the projected area of a major surface of a tabular grain. Where silver halide grains are not regular, for example, in the case of spherical or rod-shaped grains, the grain size is the diameter of an equivalent sphere having the same volume as a grain.

The shape of silver halide grains may be cubic, octahedral, tabular, spherical, rod-like and potato-like, with cubic and tabular grains being preferred in the practice of the invention. Where tabular silver halide grains are used, they should preferably have an average aspect ratio of from 100:1 to 2:1, more preferably from 50:1 to 3:1. Silver halide grains having rounded corners are also preferably used. No particular limit is imposed on the face indices (Miller indices) of an outer surface of silver halide grains. Preferably silver halide grains have a high proportion of {100} face featuring high spectral sensitization efficiency upon adsorption of a spectral sensitizing dye. The proportion of {100} face is preferably at least 50%, more preferably at least 65%, most preferably at least 80%. Note that the proportion of Miller index {100} face can be determined by the method described in T. Tani, J. Imaging Sci., 29, 165 (1985), utilizing the adsorption dependency of {111} face and {100} face upon adsorption of a sensitizing dye.

The halogen composition of photosensitive silver halide is not critical and may be any of silver chloride, silver chlorobromide, silver bromide, silver iodobromide, silver iodochlorobromide, and silver iodide. Silver bromide or silver iodobromide is preferred in the practice of the invention. Most preferred is silver iodobromide preferably having a silver iodide content of 0.1 to 40 mol %, especially 0.1 to 20 mol %. The halogen composition in grains may have a uniform distribution or a non-uniform distribution wherein the halogen concentration changes in a stepped or continuous manner. Preferred are silver iodobromide grains having a higher silver iodide content in the interior. Silver halide grains of the core/shell structure are also useful. Such core/shell grains preferably have a multilayer structure of 2 to 5 layers, more preferably 2 to 4 layers.

No particular limit is imposed on the grain size distribution of the photosensitive silver halide although a monodisperse emulsion is preferred. More specifically, the coefficient of variation of the diameter of an equivalent circle to the projected area of a silver halide grain is preferably up to 20%.

Preferably the photosensitive silver halide grains used herein contain at least one complex of a metal selected from the group consisting of rhodium, rhenium, ruthenium, osmium, iridium, cobalt, and iron. The metal complexes may be used alone or in admixture of two or more complexes of a common metal or different metals. An appropriate content of the metal complex is $1\times10^{-9}$ to $1\times10^{-2}$ mol, more preferably $1\times10^{-8}$ to $1\times10^{-4}$ mol per mol of silver. Illustrative metal complex structures are those described in JP-A 225449/1995. Preferred among cobalt and iron complexes are hexacyano metal complexes. Illustrative, non-limiting examples of cobalt and iron complexes include hexacyano metal complexes such as ferricyanate, ferrocyanate, and hexacyanocobaltate. The distribution of the metal complex in silver halide grains is not critical. That is, the metal complex may be contained in silver halide grains uniformly or at a high concentration in either the core or the shell.

Photosensitive silver halide grains may be desalted by any of well-known water washing methods such as noodle and flocculation methods although silver halide grains may be either desalted or not according to the invention.

The photosensitive silver halide grains used herein should preferably be chemically sensitized although they can be used without post-ripening. Preferred chemical sensitization methods are sulfur, selenium, and tellurium sensitization methods which are well known in the art. Also useful are a noble metal sensitization method using compounds of gold, platinum, palladium, and iridium and a reduction sensitization method. In the sulfur, selenium, and tellurium sensitization methods, any of compounds well known for the purpose may be used. For example, the compounds described in JP-A 128768/1995 are useful. Exemplary tellurium sensitizing agents include diacyltellurides, bis(oxycarbonyl)tellurides, bis(carbamoyl)-tellurides, bis(oxycarbonyl)ditellurides, bis(carbamoyl)-ditellurides, compounds having a P=Te bond, tellurocarboxylic salts, Te-organyltellurocarboxylic esters, di(poly)tellurides, tellurides, telluroles, telluroacetals, tellurosulfonates, compounds having a P-Te bond, Te-containing heterocyclics, tellurocarbonyl compounds, inorganic tellurium compounds, and colloidal tellurium. The preferred compounds used in the noble metal sensitization method include chloroauric acid, potassium chloroaurate, potassium aurithiocyanate, gold sulfide, and gold selenide as well as the compounds described in U.S. Pat. No. 2,448,060 and UKP 618,061. Illustrative examples of the compound used in the reduction sensitization method include ascorbic acid, thiourea dioxide, stannous chloride, aminoiminomethanesulfinic acid, hydrazine derivatives, boran compounds, silane compounds, and polyamine compounds. Reduction sensitization may also be accomplished by ripening the emulsion while maintaining it at pH 7 or higher or at pAg 8.3 or lower. Reduction sensitization may also be accomplished by introducing a single addition portion of silver ion during grain formation.

According to the invention, the photosensitive silver halide is preferably used in an amount of 0.01 to 0.5 mol, more preferably 0.02 to 0.3 mol, most preferably 0.03 to 0.25 mol per mol of the organic silver salt. With respect to a method and conditions of admixing the separately prepared photosensitive silver halide and organic silver salt, there may be used a method of admixing the separately prepared photosensitive silver halide and organic silver salt in a high speed agitator, ball mill, sand mill, colloidal mill, vibratory mill or homogenizer or a method of preparing an organic silver salt by adding a preformed photosensitive silver halide at any timing during preparation of an organic silver salt. Any desired mixing method may be used insofar as the benefits of the invention are fully achievable.

One of the preferred methods for preparing the silver halide according to the invention is a so-called halidation method of partially halogenating the silver of an organic silver salt with an organic or inorganic halide. Any of organic halides which can react with organic silver salts to form a silver halide may be used. Exemplary organic halides are N-halogenoimides (e.g., N-bromosuccinimide), halogenated quaternary nitrogen compounds (e.g., tetrabutylammonium bromide), and aggregates of a halogenated quaternary nitrogen salt and a molecular halogen (e.g., pyridinium bromide perbromide). Any of inorganic halides which can react with organic silver salts to form a silver halide may be used. Exemplary inorganic halides are alkali metal and ammonium halides (e.g., sodium chloride, lithium bromide, potassium iodide, and ammonium bromide), alkaline earth metal halides (e.g., calcium bromide and magnesium chloride), transition metal halides (e.g., ferric chloride and cupric bromide), metal complexes having a halogen ligand (e.g., sodium iridate bromide and ammonium rhodate chloride), and molecular halogens (e.g., bromine, chlorine and iodine). A mixture of organic and inorganic halides may also be used.

The amount of the halide added for the halidation purpose is preferably 1 mmol to 500 mmol, especially 10 mmol to 250 mmol of halogen atom per mol of the organic silver salt.

Reducing Agent

In the photosensitive material according to the invention, the reducing agent may be added to any desired layer.

The reducing agent for the organic silver salt may be any of substances, preferably organic substances, that reduce silver ion into metallic silver. Conventional photographic developing agents such as Phenidone®, hydroquinone and catechol are useful although hindered phenols are preferred reducing agents. The reducing agent should preferably be contained in an amount of 6 to 60 mol %, more preferably 10 to 40 mol % based on the moles of the organic silver salt. In a multilayer embodiment wherein the reducing agent is added to a layer other than the emulsion layer, the reducing agent should preferably be contained in a slightly larger amount of about 8 to 80 mol %, more preferably 10 to 50 mol %. The reducing agent may take the form of a precursor which is modified so as to exert its effective function only at the time of development.

For photothermographic materials using organic silver salts, a wide range of reducing agents are disclosed, for example, in JP-A 6074/1971, 1238/1972, 33621/1972, 46427/1974, 115540/1974, 14334/1975, 36110/1975, 147711/1975, 32632/1976, 1023721/1976, 32324/1976, 51933/1976, 84727/1977, 108654/1980, 146133/1981, 82828/1982, 82829/1982, 3793/1994, U.S. Pat. Nos. 3,667,958, 3,679,426, 3,751,252, 3,751,255, 3,761,270, 3,782,949, 3,839,048, 3,928,686, 5,464,738, German Patent No. 2321328, and EP 692732. Exemplary reducing agents include amidoximes such as phenylamidoxime, 2-thienylamidoxime, and p-phenoxyphenylamidoxime; azines such as 4-hydroxy-3,5-dimethoxybenzaldehydeazine; combinations of aliphatic carboxylic acid arylhydrazides with ascorbic acid such as a combination of 2,2-bis(hydroxymethyl)propionyl-β-phenylhydrazine with ascorbic acid; combinations of polyhydroxybenzenes with hydroxylamine, reductone and/or hydrazine, such as combinations of hydroquinone with bis(ethoxyethyl)hydroxylamine, piperidinohexosereductone or formyl-4-methylphenylhydrazine; hydroxamic acids such as phenylhydroxamic acid, p-hydroxyphenylhydroxamic acid, and β-anilinehydroxamic acid; combinations of azines with sulfonamidophenols such as a combination of phenothiazine with 2,6-dichloro-4-benzenesulfonamidephenol; α-cyanophenyl acetic acid derivatives such as ethyl-α-cyano-2-methylphenyl acetate and ethyl-α-cyanophenyl acetate; bis-β-naphthols such as 2,2-dihydroxy-1,1-binaphthyl, 6,6-dibromo-2,2-dihydroxy-1,l-binaphthyl, and bis(2-hydroxy-1-naphthyl)methane; combinations of bis-β-naphthols with 1,3-dihydroxybenzene derivatives such as 2,4-dihydroxybenzophenone and 2,4-dihydroxyacetophenone; 5-pyrazolones such as 3-methyl-1-phenyl-5-pyrazolone; reductones such as dimethylaminohexosereductone, anhydrodihydroaminohexosereductone and anhydrodihydropiperidonehexosereductone; sulfonamidephenol reducing agents such as 2,6-dichloro-4-benzenesulfonamidephenol and p-benzenesulfonamidephenol; 2-phenylindane-1,3-dione, etc.; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5-methylphenyl)methane, 2,2-bis(4-hydroxy-3-methyl-phenyl)propane, 4,4-ethylidene-bis(2-t-butyl-6-methyl-phenol), and 2,2-bis(3,5-dimethyl-4-hydroxyphenyl)propane; ascorbic acid derivatives such as 1-ascorbyl palmitate and ascorbyl stearate; aldehydes and ketones such as benzil and diacetyl; 3-pyrazolidones and certain indane-1,3-diones; and chromanols (tocopherols). Preferred reducing agents are bisphenols.

Toner

Better results are sometimes achieved when an additive known as a "toner" for improving images is contained. The toner may be used in an amount of 0.1 to 10% by weight of the entire silver-carrying components. Toners are well known in the photographic art as disclosed in U.S. Pat. Nos. 3,080,254, 3,446,648, 3,782,941, 3,847,612, 4,123,282, and 4,510,236, JP-A 6077/1971, 10282/1972, 5019/1974, 5020/1974, 91215/1974, 2524/1975, 32927/1975, 67132/1975, 67641/1975, 114217/1975, 3223/1976, 27923/1976, 14788/1977, 998131/1977, 1020/1978, 76020/1978, 156524/1979, 156525/1979, 183642/1986, and 56848/1992, JP-B 10727/1974 and 20333/1979, UKP 1,380,795, and Belgian Patent No. 841,910.

Examples of the toner include phthalimide and N-hydroxyphthalimide; cyclic imides such as succinimide, pyrazoline-5-one, quinazoline, 3-phenyl-2-pyrazolin-5-one, 1-phenylurazol, quinazoline and 2,4-thiazolizinedione; naphthalimides such as N-hydroxy-1,8-naphthalimide; cobalt complexes such as cobaltic hexamine trifluoroacetate; mercaptans as exemplified by 3-mercapto-1,2,4-triazole, 2,4-dimercaptopyrimidine, 3-mercapto-4,5-diphenyl-1,2,4-triazole, and 2,5-dimercapto-1,3,4-thiadiazole; N-(amino-methyl)aryldicarboxyimides such as (N,N-dimethylaminomethyl)phthalimide and N,N-(dimethylaminomethyl)-naphthalene-2,3-dicarboxyimide; blocked pyrazoles, isothiuronium derivatives and certain photo-bleach agents such as N,N'-hexamethylenebis(l-carbamoyl-3,5-dimethylpyrazole), 1,8-(3,6-diazaoctane)bis(isothiuroniumtrifluoroacetate) and 2-tribromomethylsulfonyl-benzothiazole; 3-ethyl-5-{(3-ethyl-2-benzothiazolinylidene)-1-methylethylidene}-2-thio-2,4-oxazolidinedione; phthalazinone, phthalazinone derivatives or metal salts, or derivatives such as 4-(1-naphthyl) phthalazinone, 6-chlorophthalazinone, 5,7-dimethoxyphthalazinone and 2,3-dihydro-1,4-phthalazinedione; combinations of phthalazinone with phthalic acid derivatives (e.g., phthalic acid, 4-methylphthalic acid, 4-nitrophthalic acid, and tetrachlorophthalic anhydride); phthalazine, phthalazine derivatives or metal salts, or derivatives such as 4-(l-naphthyl) phthlazine, 6-chlorophthalazine, 5,7-dimethoxyphthalazine and 2,3-dihydrophthlazine; combinations of phthalazine with phthalic acid derivatives (e.g., phthalic acid, 4-methylphthalic acid, 4-nitrophthalic acid, and tetrachlorophthalic anhydride); quinazolinedione, benzoxazine or naphthoxazine derivatives; rhodium complexes which function not only as a tone regulating agent, but also as a source of halide ion for generating silver halide in situ, for example, ammonium hexachlororhodinate (III), rhodium bromide, rhodium nitrate and potassium hexachlororhodinate (III); inorganic peroxides and persulfates such as ammonium peroxide disulfide and hydrogen peroxide; benzoxazine-2,4-diones such as 1,3-benzoxazine-2,4-dione, 8-methyl-1,3-benzoxazine-2,4-dione, and 6-nitro-1,3-benzoxazine-2,4-dione; pyrimidine and asymtriazines such as 2,4-dihydroxypyrimidine and 2-hydroxy-4 -aminopyrimidine; azauracil and tetraazapentalene derivatives such as 3,6-dimercapto-1,4-diphenyl-1H,4H-2,3a,5,$^{6}$a-tetraazapentalene, and 1,4-di(o-chlorophenyl)-3,6-dimercapto-1H,4H-2,3a,5,6a-tetraazapentalene.

Antifoqgant

With antifoggants, stabilizers and stabilizer precursors, the silver halide emulsion and/or organic silver salt according to the invention can be further protected against formation of additional fog and stabilized against lowering of sensitivity during shelf storage. Suitable antifoggants, stabilizers and stabilizer precursors which can be used alone or in combination include thiazonium salts as described in U.S. Pat. Nos. 2,131,038 and 2,694,716, azaindenes as described in U.S. Pat. Nos. 2,886,437 and 2,444,605, mercury salts as described in U.S. Pat. No. 2,728,663, urazoles as described in U.S. Pat. No. 3,287,135, sulfocatechols as described in U.S. Pat. No. 3,235,652, oximes, nitrons and nitroindazoles as described in UKP 623,448, polyvalent metal salts as described in U.S. Pat. No. 2,839,405, thiuronium salts as described in U.S. Pat. No. 3,220,839, palladium, platinum and gold salts as described in U.S. Pat. Nos. 2,566,263 and 2,597,915, halogen-substituted organic compounds as described in U.S. Pat. Nos. 4,108,665 and 4,442,202, triazines as described in U.S. Pat. Nos. 4,128,557, 4,137,079, 4,138,365 and 4,459,350, and phosphorus compounds as described in U.S. Pat. No. 4,411,985.

Preferred antifoggants are organic halides, for example, the compounds described in JP-A 119624/1975, 120328/1975, 121332/1976, 58022/1979, 70543/1981, 99335/1981, 90842/1984, 129642/1986, 129845/1987, 208191/1994, 5621/1995, 2781/1995, 15809/1996, U.S. Pat. Nos. 5,340,712, 5,369,000, and 5,464,737.

The amount of antifoggant added is preferably about 0.05 to 1,000 mg, more preferably about 0.1 to 500 mg per square meter of the photosensitive material.

Chemical addenda necessary to construct the photosensitive material of the invention including the reducing agent, toner, and antifoggant may be added in any desired form. Preferably, they are added in the form of a solid microparticulate dispersion using a dispersant as is the organic silver salt. The solid microparticulate dispersion is prepared by well-known finely dividing means as used in the preparation of the solid microparticulate dispersion of the organic silver salt. The solid microparticulate dispersion preferably has a mean particle size of 0.005 to 10 $\mu$m, more preferably 0.01 to 3 $\mu$m, most preferably 0.05 to 0.5 $\mu$m.

In the solid particle dispersion of the reducing agent, the reducing agent microparticulates should preferably have a mean particle size of 0.05 to 3.0 $\mu$m, and those particles having a size of 0.1 to 1.5 $\mu$m, especially 0.1 to 1.0 $\mu$m account for at least 70% by weight of the particles. The particle size can be determined by means of a particle size meter utilizing light scattering of light or coherent light such as laser light. The particles are substantially spherical in shape.

As the toner, two or more compounds may be used. Each of two or more compounds may be formed into a solid particle dispersion. Preferably, two or more compounds are simultaneously formed into a solid particle dispersion because the simultaneous dispersion procedure is more effective for preventing a lowering of sensitivity with time.

The toner microparticulates in the solid particle dispersion should preferably have a mean particle size of 0.05 to 3.0 $\mu$m, and those particles having a size of 0.1 to 1.5 $\mu$m, especially 0.1 to 1.0 $\mu$m account for at least 70% by weight of the particles. The particle size can be determined by means of a particle size meter utilizing light scattering of light or coherent light such as laser light. The particles are substantially spherical in shape.

The antifoggant microparticulates in the solid particle dispersion should preferably have a mean particle size of 0.1 to 10 $\mu$m, and those particles having a size of 0.1 to 0.3 $\mu$m account for at least 50% by weight of the dispersed particles.

The reducing agent and/or the toner may be contained in a layer containing the photosensitive silver halide and/or the organic silver salt or a non-photosensitive layer. In a typical embodiment wherein the photosensitive silver halide and the organic silver salt are contained in a common photosensitive layer (or emulsion layer) or an organic silver salt-containing layer, preferably the reducing agent and/or the toner is also contained in the photosensitive layer or organic silver salt-containing layer.

A layer containing the reducing agent and/or the toner is based on a binder. Preferably a polymer latex is used as a main binder. The polymer latex used herein is the same as previously described. Also preferably the layer is formed by coating a coating solution using an aqueous solvent.

The use of a polymer latex as a main binder enables the coating of a layer using an aqueous solvent, eliminating the risk involved in the coating operation using organic solvents. As opposed to the gelatin binder used in conventional aqueous solvent coating systems, a sensitivity drop and image tone deterioration are unlikely to occur and a high sensitivity and a satisfactory black image are readily obtained. Also the use of the reducing agent and/or the toner in the form of a solid particle dispersion thereof is likely to invite an improvement in coating surface state, reduced fog (Dmin), high sensitivity, and age stability. In particular, the use of at least the reducing agent in the form of a solid particle dispersion thereof is advantageous in obtaining such improved results. The additional use of the toner in the form of a solid particle dispersion thereof enables to achieve higher sensitivity and suppress the sensitivity from lowering with time. It is also preferred to use only the toner in the form of a solid particle dispersion thereof, by which improvements in coating surface state and stability during natural aging are more readily achieved.

Preferably the layer containing the reducing agent and/or the toner contains the binder in an amount of 0.2 to 10 g/m$^2$, more preferably 0.5 to 5 g/m$^2$ as expressed by a coverage per square meter of the photosensitive material. Also preferably the photosensitive layer (which may also be the layer containing the reducing agent and/or the toner) contains the binder in an amount of 0.5 to 20 g/m$^2$, more preferably 2 to 15 g/m$^2$, further preferably 3 to 10 g/m$^2$ as expressed by a coverage per square meter of the photosensitive material.

A layer containing an antifoggant included in the photothermographic material of the invention is based on a binder while a polymer latex is preferably used as a main binder. The polymer latex used herein is the same as previously described. Preferably such a layer is also formed by coating a coating solution of the antifoggant in an aqueous solvent.

The use of a solid particle dispersion of the antifoggant and a polymer latex facilitates to obtain such advantages as improved photographic properties, eliminated drop of photographic properties during aging or storage, and improved silver tone, and improved coating surface properties. The use of a polymer latex enables the coating of a layer (especially a photosensitive layer) from a coating solution in an aqueous solvent. Such a coating solution is easy to handle, which is advantageous in the manufacturing process.

According to the invention, photographic properties and coating surface properties are further improved by adding the antifoggant in the form of a solid particle dispersion. The antifoggant may be added to the same layer as the photosensitive silver halide or another layer, preferably the same layer. Better photographic properties are obtainable when a polymer latex is used as a binder in the layer to which the antifoggant is added.

Sensitizing Dye

A sensitizing dye is used in the practice of the invention. There may be used any of sensitizing dyes which can spectrally sensitize silver halide grains in a desired wavelength region when adsorbed to the silver halide grains. The sensitizing dyes used herein include cyanine dyes, merocyanine dyes, complex cyanine dyes, complex merocyanine dyes, holopolar cyanine dyes, styryl dyes, hemicyanine dyes, oxonol dyes, and hemioxonol dyes. Useful sensitizing dyes which can be used herein are described in Research Disclosure, Item 17643 IV-A (December 1978, page 23), ibid., Item 1831 X (August 1979, page 437) and the references cited therein. It is advantageous to select a sensitizing dye having appropriate spectral sensitivity to the spectral properties of a particular light source of various laser imagers, scanners, image setters and printing plate-forming cameras.

Exemplary dyes for spectral sensitization to red light include compounds I-1 to I-38 described in JP-A 18726/1979, compounds I-1 to I-35 described in JP-A 75322/1994, compounds I-1 to I-34 described in JP-A 287338/1995, dyes 1 to 20 described in JP-B 39818/1980, compounds I-1 to I-37 described in JP-A 284343/1987, and compounds I-1 to I-34 described in JP-A 287338/1995 for red light sources such as He-Ne lasers, red laser diodes and LED.

For semiconductor laser light sources in the wavelength range of 750 to 1,400 nm, spectral sensitization may be advantageously done with various known dyes including cyanine, merocyanine, styryl, hemicyanine, oxonol, hemioxonol, and xanthene dyes. Useful cyanine dyes are cyanine dyes having a basic nucleus such as a thiazoline, oxazoline, pyrroline, pyridine, oxazole, thiazole, selenazole and imidazole nucleus. Preferred examples of the useful merocyanine dye contain an acidic nucleus such as a thiohydantoin, rhodanine, oxazolidinedione, thiazolinedione, barbituric acid, thiazolinone, malononitrile, and pyrazolone nucleus in addition to the above-mentioned basic nucleus. Among the above-mentioned cyanine and merocyanine dyes, those having an imino or carboxyl group are especially effective. A suitable choice may be made of well-known dyes as described, for example, in U.S. Pat. Nos. 3,761,279, 3,719,495, and 3,877,943, UKP 1,466,201, 1,469,117, and 1,422,057, JP-B 10391/1991 and 52387/1994, JP-A 341432/1993, 194781/1994, and 301141/1994.

Especially preferred dye structures are cyanine dyes having a thioether bond-containing substituent group, examples of which are the cyanine dyes described in JP-A 58239/1987, 138638/1991, 138642/1991, 255840/1992, 72659/1993, 72661/1993, 222491/1994, 230506/1990, 258757/1994, 317868/1994, and 324425/1994, Publication of International Patent Application No. 500926/1995, and U.S. Pat. No. 5,541,054; dyes having a carboxylic group, examples of which are the dyes described in JP-A 163440/1991, 301141/1994 and U.S. Pat. No. 5,441,899; and merocyanine dyes, polynuclear merocyanine dyes, and polynuclear cyanine dyes, examples of which are the dyes described in JP-A 6329/1972, 105524/1974, 127719/1976, 80829/1977, 61517/1979, 214846/1984, 6750/1985, 159841/1988, 35109/1994, 59381/1994, 146537/1995, Publication of International Patent Application No. 50111/1993, UKP 1,467,638, and U.S. Pat. No. 5,281,515.

Also useful in the practice of the invention are dyes capable of forming the J-band as disclosed in U.S. Pat. Nos. 5,510,236, 3,871,887 (Example 5), JP-A 96131/1990 and 48753/1984.

These sensitizing dyes may be used alone or in admixture of two or more. A combination of sensitizing dyes is often used for the purpose of supersensitization. In addition to the sensitizing dye, the emulsion may contain a dye which itself has no spectral sensitization function or a compound which does not substantially absorb visible light, but is capable of supersensitization. Useful sensitizing dyes, combinations of dyes showing supersensitization, and compounds showing supersensitization are described in Research Disclosure, Vol. 176, 17643 (December 1978), page 23, IV J and JP-B 25500/1974 and 4933/1968, JP-A 19032/1984 and 192242/1984.

The sensitizing dye may be added to a silver halide emulsion by directly dispersing the dye in the emulsion or by dissolving the dye in a solvent and adding the solution to the emulsion. The solvent used herein includes water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol, N,N-dimethylformamide and mixtures thereof.

Also useful are a method of dissolving a dye in a volatile organic solvent, dispersing the solution in water or hydrophilic colloid and adding the dispersion to an emulsion as disclosed in U.S. Pat. No. 3,469,987, a method of dissolving a dye in an acid and adding the solution to an emulsion or forming an aqueous solution of a dye with the aid of an acid or base and adding it to an emulsion as disclosed in JP-B 23389/1969, 27555/1969 and 22091/1982, a method of forming an aqueous solution or colloidal dispersion of a dye with the aid of a surfactant and adding it to an emulsion as disclosed in U.S. Pat. Nos. 3,822,135 and 4,006,025, a method of directly dispersing a dye in hydrophilic colloid and adding the dispersion to an emulsion as disclosed in JP-A 102733/1978 and 105141/1983, and a method of dissolving a dye using a compound capable of red shift and adding the solution to an emulsion as disclosed in JP-A 74624/1976. It is also acceptable to apply ultrasonic waves to form a solution.

The time when the sensitizing dye is added to the silver halide emulsion according to the invention is at any step of an emulsion preparing process which has been acknowledged effective. The sensitizing dye may be added to the emulsion at any stage or step before the emulsion is coated, for example, at a stage prior to the silver halide grain forming step and/or desalting step, during the desalting step and/or a stage from desalting to the start of chemical ripening as disclosed in U.S. Pat. Nos. 2,735,766, 3,628,960, 4,183,756, and 4,225,666, JP-A 184142/1983 and 196749/1985, and a stage immediately before or during chemical ripening and a stage from chemical ripening to emulsion coating as disclosed in JP-A 113920/1983. Also as disclosed in U.S. Pat. No. 4,225,666 and JP-A 7629/1983, an identical compound may be added alone or in combination with a compound of different structure in divided portions, for example, in divided portions during a grain forming step and during a chemical ripening step or after the completion of chemical ripening, or before or during chemical ripenin-completion thereocompletion thereof. The type of compound or the combination of compounds to be added in divided portions may be changed.

The amount of the sensitizing dye used may be an appropriate amount complying with sensitivity and fog although the preferred amount is about $10^{-6}$ to 1 mol, more preferably $10^{-4}$ to $10^{-1}$ mol per mol of the silver halide in the photosensitive layer.

It is sometimes advantageous to add a mercury (II) salt to an emulsion layer as an antifoggant though not necessary in the practice of the invention. Mercury (II) salts preferred to this end are mercury acetate and mercury bromide. The mercury (II) salt is preferably added in an amount of 1 nmol to 1 mmol, more preferably 10 nmol to 100 $\mu$mol per mol of silver coated.

Still further, the photothermographic material of the invention may contain a benzoic acid type compound for the purpose of increasing sensitivity. Any of benzoic acid type compounds may be used although examples of the preferred structure are described in U.S. Pat. Nos. 4,784,939 and 4,152,160, Japanese Patent Application Nos. 98051/1996, 151241/1996, and 151242/1996. The benzoic acid type compound may be added to any site in the photothermographic material, preferably to a layer on the same side as the photosens tive layer, more preferably an organic silver salt-containing layer. The benzoic acid type compound may be added at any step in the preparation of a coating solution. Where it is contained in an organic silver salt-containing layer, it may be added at any step from the preparation of the organic silver salt to the preparation of a coating solution, referably after the preparation of the organic silver salt and immediately before coating. The benzoic acid type compound may be added in any desired form including powder, solution and fine particle dispersion. Alternatively, it may be added in a solution form after mixing it with other additives such as a sensitizing dye, reducing agent and toner. The benzoic acid type compound may be added in any desired amount, preferably 1 $\mu$mol to 2 mol, more preferably 1 mmol to 0.5 mol per mol of silver.

In the thermographic material of the invention, mercapto, disulfide and thion compounds may be added for the purposes of retarding or accelerating development to control development, improving spectral sensitization efficiency, and improving storage stability before and after development.

Where mercapto compounds are used herein, any structure is acceptable. Preferred are structures represented by Ar-S-M and Ar-S-S-Ar wherein M is a hydrogen atom or alkali metal atom, and Ar is an aromatic ring or fused aromatic ring having at least one nitrogen, sulfur, oxygen, selenium or tellurium atom. Preferred hetero-aromatic rings are benzimidazole, naphthimidazole, benzothiazole, naphthothiazole, benzoxazole, naphthoxazole, benzoselenazole, benzotellurazole, imidazole, oxazole, pyrrazole, triazole, thiadiazole, tetrazole, triazine, pyrimidine, pyridazine, pyrazine, pyridine, purine, quinoline and quinazolinone rings. These hetero-aromatic rings may have a substituent selected from the group consisting of halogen (e.g., Br and Cl), hydroxy, amino, carboxy, alkyl groups (having at least 1 carbon atom, preferably 1 to 4 carbon atoms), and alkoxy groups (having at least 1 carbon atom, preferably 1 to 4 carbon atoms). Illustrative, non-limiting examples of the mercapto-substituted hetero-aromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 3-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, and 2-mercapto-4-phenyloxazole.

These mercapto compounds are preferably added to the emulsion layer in amounts of 0.001 to 1.0 mol, more preferably 0.01 to 0.3 mol per mol of silver.

In the photosensitive layer, polyhydric alcohols (e.g., glycerin and diols as described in U.S. Pat. No. 2,960,404), fatty acids and esters thereof as described in U.S. Pat. Nos 2,588,765 and 3,121,060, and silicone resins as described in UKP 955,061 may be added as a plasticizer and lubricant.

Surface Protective Layer

A surface protective layer may be provided in the photosensitive material according to the present invention for the purpose of preventing adhesion of an image forming layer. Any desired binder may be used in the surface protective layer although it is preferably selected from natural and synthetic resins and synthetic polymers which can be used in the image forming layer. A hydrophilic polymer is preferably used, especially in an amount of at least 30% by weight of the entire binder.

The hydrophilic polymer may be selected from gelatin, polyvinyl alcohol (PVA), casein, agar, gum arabic, hydroxyethyl cellulose, cellulose acetate, cellulose acetate butyrate, polyvinyl chloride, polymethacrylic acid, polyvinylidene chloride, and polyvinyl acetate. Gelatin is preferred among others. The gelatin may be any of lime-treated gelatin, acid-treated gelatin and otherwise treated gelatin. Gelatin derivatives are also useful. A polymer latex of ethyl acrylate, for example, may be added to the hydrophilic polymer as the binder of the surface protective layer.

The surface protective layer preferably has a thickness of 0.1 to 10 $\mu$m, more preferably 0.5 to 5 $\mu$m.

The surface protective layer is preferably formed by coating an aqueous coating solution and drying the coating as previously mentioned.

Also preferably, the surface protective layer is crosslinked with a crosslinking agent. The crosslinking agent used herein is not critical and may be any of well-known crosslinking agents such as epoxy compounds, isocyanate compounds, melamine compounds, and phenol compounds. As the isocyanate compounds, blocked isocyanates may also be used. Where gelatin is the binder in the surface protective layer, crosslinking agents such as active halogen compounds and vinyl sulfone compounds are preferred. Where polyvinyl alcohol is the binder in the surface protective layer, boric acid is also a preferred crosslinking agent. With respect to the crosslinking agent, reference should be made to Yamashita, "Crosslinking Agent Handbook," Taisei K.K., 1981, for example.

The amount of the crosslinking agent added is preferably 0.5 to 30%, more preferably 1 to 10% by weight of the binder in the non-photosensitive surface protective layer. Examples of the crosslinking agent which can be used for the crosslinking of the surface protective layer are given below as H-1 to H-7.

H-1

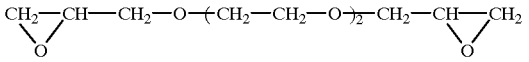

H-2

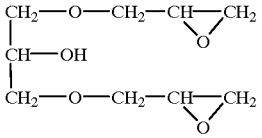

H-3

H-4

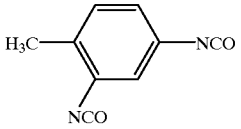

H-5

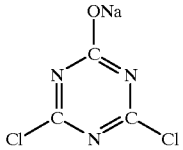

H-6

H-7

The surface protective layer may contain anprevention-preventing material. Examples of the adhesion-preventing material include wax, silica particles, styrene-containing elastomeric block copolymers (e.g., styrene-butadienestyrene and styrene-isoprene-styrene), cellulose acetate, cellulose acetate butyrate, cellulose propionate and mixtures thereof.

If desired, the surface protective layer contains an organic silver salt, reducing agent therefor, toner, antifoggant, matte agent, dyestuff, lubricant (such as silicon compounds and paraffin), surfactant, and so on.

In the emulsion layer or a protective layer therefor according to the invention, there may be used light absorbing substances and filter dyes as disclosed in U.S. Pat. Nos. 3,253,921, 2,274,782, 2,527,583, and 2,956,879. The dyes may be mordanted as described in U.S. Pat. No. 3,282,699.

Intermediate Layer

Also preferably, the photothermographic material of the invention further includes a non-photosensitive layer or intermediate layer between the photosensitive layer (or emulsion layer) and the surface protective layer.

The intermediate layer is based on a binder which may be either a hydrophilic polymer or a hydrophobic polymer. The term "hydrophilic polymer" used herein is a polymer which is soluble in water at 25° C. in a concentration of at least 1% by weight whereas the term "hydrophobic polymer" is a polymer which is soluble in water at 25° C. in a concentration of less than 1% by weight. Examples of the hydrophilic polymer include gelatin, polyvinyl alcohol (PVA), casein, agar, methyl cellulose, ethyl cellulose, carboxymethyl cellulose, hydroxypropyl cellulose, and hydroxypropyumethyl cellulose. Examples of the hydrophobic polymer include acrylic resins, polyester resins, polyurethane resins, vinylidene chloride resins, polystyrene, cellulose resins, and rubbery resins it is preferred for fog, sensitivity and image tone that a polymer latex constitutes at least 50% by weight of the binder. It is preferred for graininess and sensitivity that a hydrophilic polymer constitutes at least 50% by weight of the binder.

The intermediate layer preferably has a thickness of 0.1 to 10 $\mu$m, more preferably 0.5 to 5 $\mu$m.

The intermediate layer is preferably formed by coating an aqueous coating solution and drying the coating as previously mentioned. Where a hydrophobic polymer is used, a polymer latex thereof is preferably used, enabling that an aqueous coating solution thereof be coated and then dried to form the intermediate layer.

To the intermediate layer, various components are added if desired, for example, organic silver salts, reducing agents therefor, toners, antifoggants, crosslinking agents, matte agents, dyestuffs, and surfactants.

If desired, the intermediate layer is crosslinked with a crosslinking agent. The crosslinking agent used herein is not critical and may be any of crosslinking agents well known for hydrophilic and hydrophobic polymers such as epoxy compounds, urethane compounds, isocyanate compounds, active halogen compounds, and vinyl sulfone compounds.

In one preferred embodiment, the photothermographic material of the invention is a one-side photosensitive material having at least one photosensitive layer containing a silver halide emulsion on one side and a back (or backing) layer on the other side of the support.

The back layer preferably exhibits a maximum absorbance of about 0.3 to 2.0, more preferably about 0.5 to 2.0 in the predetermined wavelength range. Where the predetermined wavelength range is 750 to 1,400 nm, the back layer preferably has an absorbance of 0.001 to less than 0.5 in the visible range. More preferably the back layer is an antihalation layer having an optical density of 0.001 to less than 0.3. Where the predetermined wavelength range is up to 750 nm, the back layer is preferably an antihalation layer having a maximum absorbance of 0.3 to 2.0 before image formation and an optical density of 0.001 to less than 0.5, more preferably 0.005 to less than 0.3 after image formation. The means for reducing the optical density after image formation to the above-mentioned range is not critical although the density is preferably reduced by thermal decolorization of a dyestuff as disclosed in Belgian Patent No. 733,706 or by decolorization of a dyestuff upon light irradiation as disclosed in JP-A 17833/1979.

Where antihalation dyestuffs are used in the back layer according to the invention, such a dyestuff may be any compound which has desired absorption in a predetermined wavelength range and provides the back layer with a preferred absorbance spectrum profile.

In the practice of the invention, the binder used in the back layer is preferably transparent or translucent and generally colorless. Exemplary binders are naturally occurring polymers, synthetic resins, polymers and copolymers, and other film-forming media, for example, gelatin, gum arabic, poly(vinyl alcohol), hydroxyethyl cellulose, cellulose acetate, cellulose acetate butyrate, poly(vinyl pyrrolidone), casein, starch, poly(acrylic acid), poly(methyl methacrylic acid), polyvinyl chloride, poly-(methacrylic acid), copoly (styrene-maleic anhydride), copoly(styrene-acrylonitrile), copoly(styrene-butadiene), polyvinyl acetals (e.g., polyvinyl formal and polyvinyl butyral), polyesters, polyurethanes, phenoxy resins, poly(vinylidene chloride), polyepoxides, polycarbonates, poly(vinyl acetate), cellulose esters, and polyamides. The binder may be dispersed in water, organic solvent or emulsion to form a dispersion which is coated to form a layer.

In the one-side photosensitive material according to the invention, a matte agent may be added to the surface protective layer for the photosensitive emulsion layer and/or the back layer for improving feed efficiency. The matte agents used herein are generally microparticulate water-insoluble organic or inorganic compounds. There may be used any desired one of matte agents, for example, well-known matte agents including organic matte agents as described in U.S. Pat. Nos. 1,939,213, 2,701,245, 2,322,037, 3,262,782, 3,539,344, and 3,767,448 and inorganic matte agents as described in U.S. Pat. Nos. 1,260,772, 2,192,241, 3,257,206, 3,370,951, 3,523,022, and 3,769,020. Illustrative examples of the organic compound which can be used as the matte agent are given below; exemplary water-dispersible vinyl polymers include polymethyl acrylate, polymethyl methacrylate, polyacrylonitrile, acrylonitrile-α-methylstyrene copolymers, polystyrene, styrene-divinylbenzene copolymers, polyvinyl acetate, polyethylene carbonate, and polytetrafluoroethylene; exemplary cellulose derivatives include methyl cellulose, cellulose acetate, and cellulose acetate propionate; exemplary starch derivatives include carboxy-starch, carboxynitrophenyl starch, urea-formaldehyde-starch reaction products, gelatin hardened with well-known curing agents, and hardened gelatin which has been coaceruvation hardened into microcapsulated hollow particles. Preferred examples of the inorganic compound which can be used as the matte agent include silicon dioxide, titanium dioxide, magnesium dioxide, aluminum oxide, barium sulfate, calcium carbonate, silver chloride and silver bromide desensitized by a well-known method, glass, and diatomaceous earth. The aforementioned matte agents may be used as a mixture of substances of different types if necessary. The size and shape of the matte agent are not critical. The matte agent of any particle size may be used although it is preferred in the practice of the invention to use a matte agent having a particle size of 0.1 μm to 30 μm, more preferably 0.2 to 20 μm, most preferably 0.5 to 10 μm. The particle size distribution of the matte agent may be either narrow or wide. Nevertheless, since the haze and surface luster of photosensitive material are largely affected by the matte agent, it is preferred to adjust the particle size, shape and particle size distribution of a matte agent as desired during preparation of the matte agent or by mixing plural matte agents.

In one preferred embodiment of the invention, a matte agent is added to the back layer. The back layer should preferably have a degree of matte as expressed by a Bekk smoothness of 10 to 250 seconds, more preferably 50 to 180 seconds.

In the photosensitive material of the invention, the matte agent is preferably contained in an outermost surface layer, a layer functioning as an outermost surface layer, a layer close to the outer surface or a layer functioning as a so-called protective layer. The emulsion surface protective layer may have any degree of matte insofar as no star dust failures occur although a Bekk smoothness of 1,000 to 10,000 seconds, especially up to 2,000 seconds is preferred.

It is especially preferred in the practice of the invention to use a matte agent in the form of spherical silica. The spherical silica matte agent may be added to any of the layers of the photothermographic material, preferably the surface protective layer, back layer or back protective layer as in the previous embodiments, especially the surface protective layer or back protective layer.

The spherical silica matte agent used herein is silica microparticulates of true spherical shape. By the term "true spherical shape" it is meant that the ratio (r) of the major diameter (a) of a photographic image of a particle to the diameter (b) of a circle having the same area as the image is up to 1.2 on the average for all particles. In practice, the average ratio is determined as follows. A matte agent is photographed through a scanning electron microscope. In the photograph, 100 particles are picked up. Their major diameter (a) is measured. The diameter (b) of a circle having the same area as the particle image is calculated. The ratio (r=a/b) is calculated. An average (R) of the ratios (r) of 100 particles is calculated. When the average (R) is 1.2 or less, the matte agent is regarded true spherical.

Preferably the spherical silica matte agent used herein has a mean particle size of 0.3 to 20 μm, more preferably 0.5 to 10 μm, the mean particle size being given as an average D of the b values of 100 particles. A too small mean particle size would achieve no matte effect whereas a matte agent with a too large mean particle size would readily strip off and cause white pepper failure. The spherical silica matte agent preferably has a narrower particle size distribution. Specifically, at least 60% of the entire particles have a size in the range of 0.7D to 1.3D, more preferably 0.8D to 1.2D with respect to the mean particle size D. In order to obtain such a narrow particle size distribution, matte agent particles may be classified as by wet sedimentation classification or air classification.

If desired, the spherical silica matte agent is surface treated. For surface treatment, there are known a number of techniques, for example, surface treatment with silane coupling agents, surface treatment with titanium coupling agents, and mechanochemical surface treatment. The surface treatment with silane coupling agents is preferred.

The amount of the matte agent added is not specifically limited since it varies with the thickness of the photothermographic material and the particle size of the matte agent. Preferably the amount of the matte agent added is 5 to 200 $mg/m^2$, more preferably 10 to 100 $mg/m^2$, most preferably 20 to 100 $mg/m^2$. Outside this range, less amounts of the matte agent would achieve no matte effect whereas larger amounts would exacerbate haze.

Any desired binder may be used in the layer to which the spherical silica matte agent is added. Either hydrophobic or hydrophilic polymers may be used. Examples of the hydrophobic polymer include polyvinyl butyrate, cellulose acetate, polystyrene, and vinyl chloride. Examples of the hydrophilic polymer include gelatin, polyvinyl alcohol, casein, agar, methyl cellulose, ethyl cellulose, carboxymethyl cellulose, hydroxypropyl cellulose, and hydroxypropyumethyl cellulose.

A backside resistive heating layer as described in U.S. Pat. Nos. 4,460,681 and 4,374,921 may be used in a thermographic imaging system according to the present invention.

If desired, other components such as surfactants, crosslinking agent, and lubricants are added to the back layer.

In the photothermographic material of the invention, a protective layer (back surface protective layer) may be formed on the back layer. Any desired binder may be used in the back surface protective layer. Any of the polymers described for the back layer may be used although hydrophilic polymers are preferred. The back protective layer is also preferably formed by coating an aqueous coating solution and drying the coating as previously described. Also preferably, the back protective layer is crosslinked as is the surface protective layer. Any of the aforementioned crosslinking agents be used. If desired, matte agents, dyestuffs, lubricants, surfactants, and other components as previously described are added to the back protective layer. The back protective layer preferably has a thickness of 0.1 to 10 $\mu$m, more preferably 0.5 to 5 $\mu$m.

According to the invention, the photothermographic emulsion may be coated on a variety of supports. Typical supports include polyester film, subbed polyester film, poly (ethylene terephthalate) film, polyethylene naphthalate film, cellulose nitrate film, cellulose ester film, poly(vinyl acetal) film, polycarbonate film and related or resinous materials, as well as glass, paper, metals, etc. Often used are flexible substrates, typically paper supports, specifically baryta paper and paper supports coated with partially acetylated $\alpha$-olefin polymers, especially polymers of $\alpha$-olefins having 2 to 10 carbon atoms such as polyethylene, polypropylene, and ethylene-butene copolymers. The supports are either transparent or opaque, preferably transparent. Among others, biaxially oriented polyethylene terephthalate (PET) film of about 100 to 200 $\mu$m thick is especially preferred.

For antistatic purposes, the photosensitive material of the invention may have an electroconductive layer, for example, a layer containing soluble salts (e.g., chlorides and nitrates), an evaporated metal layer, and layers containing ionic polymers as described in U.S. Pat. Nos. 2,861,056 and 3,206,312, insoluble inorganic salts as described in U.S. Pat. No. 3,428,451, and tin oxide microparticulates as described in JP-A 252349/1985 and 104931/1982. The support is tinted if desired.

A method for producing color images using the photothermographic material of the invention is as described in JP-A 13295/1995, page 10, left column, line 43 to page 11, left column, line 40. Stabilizers for color dye images are exemplified in UKP 1,326,889, U.S. Pat. Nos. 3,432,300, 3,698,909, 3,574,627, 3,573,050, 3,764,337, and 4,042,394.

In the practice of the invention, the photothermographic emulsion can be coated by various coating procedures including dip coating, air knife coating, flow coating, and extrusion coating using a hopper of the type described in U.S. Pat. No. 2,681,294. If desired, two or more layers (for example, a combination of the emulsion layer and the surface protective layer) may be concurrently coated by the methods described in U.S. Pat. No. 2,761,791 and UKP 837,095. According to the invention, such two or more layers are preferably formed by a simultaneous multilayer coating technique of simultaneously applying coating solutions for the respective layers and drying the coatings.

In the photothermographic material of the invethere, there may be contained additional layers, for example, a dye accepting layer for accepting a mobile dye image, an opacifying layer when reflection printing is desired, a protective topcoat layer, and a primer layer well known in the photothermographic art. The photosensitive material of the invention is preferably such that only a single sheet of the photosensitive material can form an image. That is, it is preferred that a functional layer necessary to form an image such as an image receiving layer does not constitute a separate member.

In the photothermographic material of the invention, a contrast enhancer may be used for forming ultrahigh contrast images. Hydrazine derivatives are typical contrast enhancers. The hydrazine derivative is preferably selected from the compounds of formula (I) in Japanese Patent Application No. 47961/1994, more particularly compounds I-1 to I-53 disclosed therein.

Other contrast enhancers are also useful. Such hydrazine derivatives included the compounds of the chemical formula [1] in JP-B 77138/1994, more specifically the compounds described on pages 3 and 4 of the same; the compounds of the general formula (1) in JP-B 93082/1994, more specifically compound Nos. 1 to 38 described on pages 8 to 18 of the same; the compounds of the general formulae (4), (5) and (6) in JP-A 230497/1994, more specifically compounds 4-1 to 4-10 described on pages 25 and 26, compounds 5-1 to 5-42 described on pages 28 to 36, and compounds 6-1 to 6-7 described on pages 39 and 40 of the same; the compounds of the general formulae (1) and (2) in JP-A 289520/1994, more specifically compounds 1-1 to 1-17 and 2-1 described on pages 5 to 7 of the same; the compounds of the chemical formulae [2] and [3] in JP-A 313936/1994, more specifically the compounds described on pages 6 to 19 of the same; the compounds of the chemical formula [1] in JP-A 313951/1994, more specifically the compounds described on pages 3 to 5 of the same; the compounds of the general formula (I) in JP-A 5610/1995, more specifically compounds I-1 to I-38 described on pages 5 to 10 of the same; the compounds of the general formula (II) in JP-A 77783/1995, more specifically compounds II-1 to II-102 described on pages 10 to 27 of the same; the compounds of the general formulae (H) and (Ha) in JP-A 104426/1995, more specifically compounds H-1 to H-44 described on pages 8 to 15 of the same; the compounds having an anionic group in proximity to a hydrazine group or a nonionic group forming an intermolecular hydrogen bond with the hydrogen atom of hydrazine in Japanese Patent Application No. 191007/1995, specifically the compounds of general formulae (A), (B), (C), (D), (E) and (F), more specifically compounds N-1 to N-30; and the compounds of the general formula (1) in Japanese Patent Application No. 191007/1995, more specifically compounds D-1 to D-55.

Also included are hydrazine derivatives as described in U.S. Pat. Nos. 5,464,738, 5,496,695, 5,512,411, 5,536,622, Japanese Patent Application Nos. 228627/1995, 215822/1996, 130842/1996, 148113/1996, 156378/1996, 148111/1996, and 148116/1996; compounds having a quaternary nitrogen atom as described in Japanese Patent Application No. 83566/1996, and acrylonitrile compounds as described in U.S. Pat. No. 5,545,515. Illustrative examples are compounds 1 to 10 in U.S. Pat. No. 5,464,738, compounds H-1 to H-28 in U.S. Pat. No. 5,496,695, compounds I-1 to I-86 in Japanese Patent Application No. 215822/1996, compounds H-1 to H-62 in 130842/1996, compounds I-1 to I-21 in 148113/1996, compounds 1 to 50 in 148111/1996, compounds 1 to 40 in 148116/1996, and compounds P-1 to P-26 and T-1 to T-18 in 83566/1996, and compounds CN-1 to CN-13 in U.S. Pat. No. 5,545,515.

A contrast enhancement accelerator may be used along with the contrast enhancer for the purpose of forming ultrahigh contrast images. Exemplary are the amine compounds described in U.S. Pat. No. 5,545,505, specifically AM-1 to AM-5; hydroxamic acid type compounds described in U.S. Pat. No. 5,545,507, specifically HA-1 to HA-11, acrylonitriles described in U.S. Pat. No. 5,545,507, specifically CN-1 to CN-13, hydrazine compounds described in U.S. Pat. No. 5,558,983, specifically CA-1 to CA-6, onium salts described in Japanese Patent Application No. 132836/1996, specifically A-1 to A-42, B-1 to B-27, and C-1 to C-14.

In the practice of the invention, the hydrazine nucleating agent may be used after it is dissolved in a suitable water-miscible organic solvent, for example, alcohols (e.g., methanol, ethanol, propanol and fluorinated alcohols), ketones (e.g., acetone and methyl ethyl ketone), dimethylformamide, dimethylsulfoxide, and methyl cellosolve.

Also, a well-known emulsifying dispersion method is used for dissolving the hydrazine nucleating agent with the aid of an oil such as dibutyl phthalate, tricresyl phosphate, glyceryl triacetate and diethyl phthalate or an auxiliary solvent such as ethyl acetate and cyclohexanone whereby an emulsified dispersion is mechanically prepared. Alternatively, a method known as a solid dispersion method is used for dispersing the hydrazine derivative in powder form in water in a ball mill, colloidal mill or ultrasonic mixer.

The hydrazine nucleating agent according to the invention may be added to a silver halide emulsion layer on a support or another hydrophilic colloid layer on the same side as the silver halide emulsion layer, preferably the silver halide emulsion layer or a hydrophilic colloid layer disposed adjacent thereto.

The hydrazine nucleating agent is preferably used in an amount of 1 μmol to 10 mmol, more preferably 10 μmol to 5 mmol, most preferably 20 μmol to 5 mmol per mol of silver halide.

The photosensitive material of the invention may be developed by any desired method although it is generally developed by heating after imagewise exposure. The preferred developing temperature is about 80 to 250° C., more preferably 100 to 140° C. and the preferred developing time is about 1 to 180 seconds, more preferably about 10 to 90 seconds.

Any desired technique may be used for the exposure of the photothermographic material of the invention. A choice may be made of well-known exposure techniques using tungsten lamps, mercury lamps, lasers, CRT light sources, xenon lamps, and iodide lamps. Among these, exposure techniques using lasers are preferred.

Upon exposure, the photosensitive material of the invention tends to generate interference fringes due to low haze. Known techniques for preventing generation of interference fringes are a technique of obliquely directing laser light to a photosensitive material as disclosed in JP-A 113548/1993 and the utilization of a multi-mode laser as disclosed in WO 95/31754. These techniques are preferablv used herein.

Upon exposure of the photosensitive material of the invention, exposure is preferably made by overlapping laser light so that no scanning lines are visible, as disclosed in SPIE, Vol. 169, Laser Printing 116–128 (1979), JP-A 51043/1992, and WO 95/31754.

EXAMPLE

Examples of the present invention are given below by way of illustration and not by way of limitation.

The trade names used in Examples have the following meaning.

LACSTAR 3307B: styrene-butadiene rubber (SBR) latex by Dai-Nihon Ink Chemical Industry K.K.

Sildex: spherical silica by Dokai Chemical K.K.

Example 1

Silver halide crains A

In 700 ml of water were dissolved 22 grams of phthalated gelatin and 30 mg of potassium bromide. The solution was adjusted to pH 5.0 at a temperature of 40° C. To the solution, 159 ml of an aqueous solution containing 18.6 grams of silver nitrate and an aqueous solution of potassium bromide were added over 10 minutes by the controlled double jet method while maintaining the solution at pAg 7.7. Then, 476 ml of an aqueous solution containing 55.4 grams of silver nitrate and an aqueous solution containing 8 ,mol/liter of dipotassium hexachloroiridate and 1 mol/liter of potassium bromide were added over 30 minutes by the controlled double jet method while maintaining the solution at pAg 7.7. The pH of the solution was lowered to cause flocculation and sedimentation for desalting. The solution was adjusted to pH 5.9 and pAg 8.0 by adding 0.1 gram of phenoxyethanol. There were obtained cubic grains having a mean grain size of 0.07 μm, a coefficient of variation of the projected area diameter of 8%, and a (100) face proportion of 86%.

The thus obtained silver halide grains were heated at 60° C., to which 85 ,umol of sodium thiosulfate, 11 μmol of 2,3,4,5,6-pentafluorophenyldiphenylphosphine selenide, 2 μmol of Tellurium compound 1, 3.3 μmol of chloroauric acid, and 230 μmol of thiocyanic acid were added per mol of silver. The solution was ripened for 120 minutes. Thereafter, the temperature was changed to 50° C. and with stirring, $5\times10^{-4}$ mol of Sensitizing dye A and $2\times10^{-4}$ mol of Sensitizing dye B were added, both per mol of the silver halide. Potassium iodide was further added in an amount of 3.5 mol % based on the moles of silver. The emulsion was stirred for 30 minutes and then quenched to 30° C., completing the preparation of silver halide grains A.

Sensitizing dyes A and B and Tellurium compound 1 have the following structure.

Sensitizing dye A

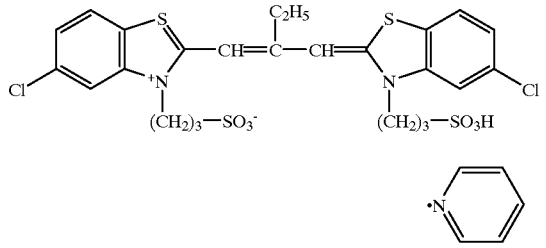

Sensitizing dye B

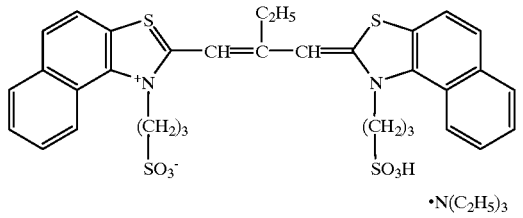

Tellurium compound 1

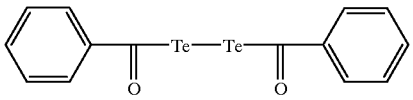

Microcrystalline dispersion A of organic acid silver salt

A mixture of 40 grams of behenic acid, 7.3 grams of stearic acid, and 500 ml of distilled water was stirred at 90° C. for 15 minutes. 187 ml of 1N NaOH aqueous solution was added to the solution over 15 minutes and 61 ml of 1N nitric acid aqueous solution was added to the solution, which was cooled to 50° C. Next, 124 ml of 1N silver nitrate aqueous solution was added to the solution over 2 minutes, and agitation was continued for a further 30 minutes. The solids were separated by suction filtration and washed with water until the water filtrate reached a conductivity of 30 μS/cm. The thus collected solids were handled as wet cake without drying. To an amount of the wet cake corresponding to 34.8 grams of dry solids, 12 grams of polyvinyl alcohol and 150 ml of water were added. A slurry was obtained by thorough agitation. The slurry was admitted into a vessel together with 840 grams of zirconia beads having a mean diameter of 0.5 mm. Dispersion was done for 5 hours by means of a dispersing machine (1/4G sand grinder mill by Imex K.K.), completing the preparation of a microcrystalline dispersion of organic acid silver salt having a volume weighed mean diameter of 1.5 μm as measured by Master Sizer X by Malvern Instruments Ltd.

Microcrystalline dispersions B to E of organic acid silver salt

By following the same procedure as the organic acid silver microcrystalline dispersion A except that the amount of polyvinyl alcohol added was changed, there were prepared organic acid silver microcrystalline dispersions B, C, D, and E having a different mean particle size. The thus obtained organic acid silver microcrystalline dispersion had a volume weighed mean diameter as reported in Table 1.

Solid -oarticle dispersions of chemical addenda

Solid particle dispersions of tetrachlorophthalic acid, 4-methylphthalic acid, 1,1-bis(2-hydroxy-3,5-dimethylphenyl)-3,5,5-trimethylhexane, phthalazine, and tribromomethylphenylsulfone were prepared.

To tetrachlorophthalic acid were added 0.81 grams of hydroxypropyumethyl cellulose and 94.2 ml of water. They were thoroughly agitated to form a slurry, which was allowed to stand for 10 hours. A vessel was charged with the slurry together with 100 ml of zirconia beads having a mean diameter of 0.5 mm. A dispersing machine as above was operated for 5 hours for dispersion, obtaining a solid particle dispersion of tetrachlorophthalic acid in which particles with a diameter of up to 1.0 μm accounted for 70% by weight. Solid particle dispersions of the remaining chemical addenda were similarly prepared by properly changing the amount of dispersant and the time of dispersion to achieve a desired mean particle size.

Emulsion layer coating solution 1

An emulsion layer coating solution 1 was prepared by adding silver halide grains A in an amount of 10 mol % of silver halide based on the moles of organic acid silver, a binder (shown below) and the chemical addenda to the above-prepared organic acid silver microcrystalline dispersion A (equivalent to 1 mol of silver). The chemical addenda were added in the form of solid particle dispersions as mentioned above.

Binder:

LACSTAR 3307B SBR latex 430 g

Chemical addenda for development:

Tetrachlorophthalic acid 5 g 1,1-bis(2-hydroxy-3,5-dimethylphenyl)-3,5,5-trimethylhexane 98 g Phthalazine 9.2 g Tribromomethylphenylsulfone 12 g 4-methylphthalic acid 7 g Emulsion surface protective layer coating solution A surface protective layer coating solution was prepared by mixing 10 grams of inert gelatin with 0.26 gram of Surfactant A, 0.09 gram of Surfactant B, 0.9 gram of silica particles with a mean particle size of 2.5 μm, 0.3 gram of 1,2-bis(vinylsulfonylacetamido)ethane, and 64 grams of water.

Surfactant A

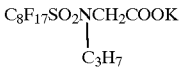

Surfactant B

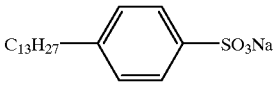

Color developing agent dispersion

To 35 grams of ethyl acetate were added 2.5 grams of Compound 1 and 7.5 grams of Compound 2. The mixture was agitated for dissolution. The solution was combined with 50 grams of a 10 wt % polyvinyl alcohol solution and agitated for 5 minutes by means of a homogenizer. Thereafter, the ethyl acetate was volatilized off for solvent removal purpose. Dilution with water yielded a color developing agent dispersion.

Compound 1

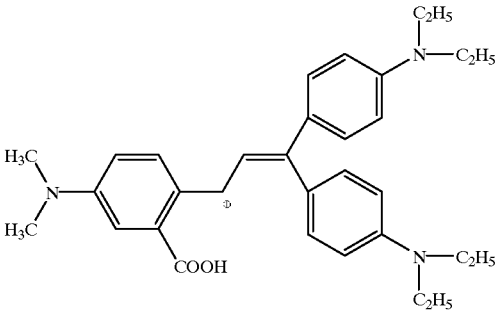

Compound 2

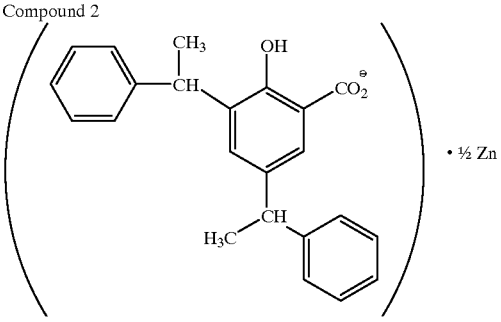

Back surface coating solution

A back surface coating solution was prepared by adding 50 grams of the color developing agent dispersion, 20 grams of Compound 3, 250 grams of water, and 1.8 grams of sildex H121 spherical silica having a mean particle size of 12 μm to 30 grams of polyvinyl alcohol.

Compound 3

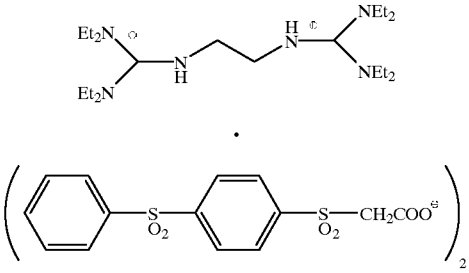

Coated sample No. 101 to 115

The emulsion layer coating solution 1 prepared above was coated onto a polyethylene terephthalate support of 175 μm thick tinted with a blue dyestuff so as to give a silver coverage of 1.9 g/m$^2$. The emulsion surface protective layer coating solution was then coated onto the emulsion coating so as to give a binder coverage of 1.8 g/m$^2$. After drying, the back surface coating solution was coated onto the surface of the support opposite to the emulsion layer so as to give an optical density of 0.7 at 660 nm, obtaining sample No. 101.

Sample Nos. 102 to 115 were similarly prepared while changing the binder and the organic silver microcrystalline dispersion as shown in Table 1.

Note that LACSTAR 3307B and P-1 to P-6 used herein are polymer latices whose dispersed particles have a mean particle size of 0.1 to 0.15 μm, and PVA-205 is a polyvinyl alcohol. As noted above, LACSTAR 3307B is a SBR latex containing a styrene-butadiene copolymer.

For sample Nos. 101 to 115, the binders used in their photosensitive layer were measured for equilibrium moisture content. The samples were examined for coating surface quality and silver tone by the following methods.

Measurement of moisture content of binder

A solution or dispersion of the polymer used in the photosensitive layer was coated on a glass plate and dried at 50° C. for one hour to form a model polymer film of 100 μm thick. When two or more polymers were used as a binder in the layer, a sample was prepared by mixing these polymers in the same ratio as in that layer. The model polymer film was stripped from the glass plate and allowed to stand at 25° C. and RH 60% for 3 days before its weight (W1) was measured. The model polymer film was then allowed to stand at 25° C. vacuum for 3 days. Immediately thereafter, the film was placed in a weighing bottle having a known weight (W2). From the weight (W3) of the bottle, the weight of the dry polymer film was calculated (W0=W3−W2). The equilibrium moisture content (Weq) at 25° C. and RH 60% of the polymer was calculated according to the equation: Weq=(W1−W0)/W0×100% by weight.

Coating surface quality

A coated sample was cut into a section of 10 cm×10 cm. The number of agglomerates appearing as measles was counted. Coating surface quality is rated according to the following criterion.

| Rating | Number of agglomerates |
|---|---|
| ◎ | 0–5 |
| ○ | 6–20 |
| Δ | 20–100 |
| x | >100 |

The rating "○" is on the acceptable level.

Silver tone after processing

A coated sample was exposed at an incident angle of 30° by means of a laser sensitometer equipped with a 647-nm Kr laser (maximum power 500 mW) and developed at 120° C. for 15 seconds. The developed sample was visually observed under white light. In a sensory test, a shift from the black tone regarded favorable for practical use was rated on the following scale.

Rating

◎ perceived black

○ a slight unnoticeable tone shift from black

Δ perceived brown, yellow or red depending on an exposure x perceived brown, yellow or red The rating "○" is on the acceptable level.

The results are shown in Table 1.

TABLE 1

| | Photosensitive layer binder | | Organic silver salt dispersion | | Coating | | |
|---|---|---|---|---|---|---|---|
| Sample No. | Type | Moisture content (wt %) | Type | Particle size | Coating solvent | surface quality | Silver tone |
| 101 (invention) | LACSTAR 3307B | 0.6 | A | 1.5 μm | water | ◎ | ◎ |
| 102 (invention) | LACSTAR 3307B | 0.6 | B | 5.0 μm | water | ◎ | ◎ |
| 103 (invention) | LACSTAR 3307B | 0.6 | C | 7.0 μm | water | ○ | ◎ |
| 104 (comparison) | LACSTAR 3307B | 0.6 | D | 15.0 μm | water | Δ | ○ |
| 105 (comparison) | LACSTAR 3307B | 0.6 | E | 30.0 μm | water | X | ○ |
| 106 (comparison) | PVA-205 | 4.2 | A | 1.5 μm | water | ○ | X |

TABLE 1-continued

| Sample No. | Photosensitive layer binder Type | Moisture content (wt %) | Organic silver salt dispersion Type | Particle size | Coating solvent | Coating surface quality | Silver tone |
|---|---|---|---|---|---|---|---|
| 107 (comparison) | PVA-205 | 4.2 | C | 7.0 μm | water | ○ | X |
| 108 (comparison) | PVA-205 | 4.2 | E | 30.0 μm | water | X | X |
| 109 (comparison) | gelatin | 10.5 | C | 7.0 μm | water | X | Δ |
| 110 (invention) | P-1 | 0.6 | A | 1.5 μm | water | ⊙ | ⊙ |
| 111 (invention) | P-2 | 0.4 | A | 1.5 μm | water | ⊙ | ⊙ |
| 112 (invention) | P-3 | 0.3 | A | 1.5 μm | water | ⊙ | ⊙ |
| 113 (invention) | P-4 | 0.5 | A | 1.5 μm | water | ⊙ | ⊙ |
| 114 (invention) | P-5 | 0.3 | A | 1.5 μm | water | ⊙ | ⊙ |
| 115 (invention) | P-6 | 0.3 | A | 1.5 μm | water | ⊙ | ⊙ |

As is evident from Table 1, photothermographic material samples having good coating surface quality and silver tone are obtained by using a polymer originating from a polymer latex as a main binder in a photosensitive layer and a solid particle dispersion of organic silver salt falling in the scope of the invention. The invention is advantageous from the standpoints of environment and cost since these samples are formed by coating aqueous solvent systems.

After the coated samples were exposed by means of a laser sensitometer equipped with a 647-nm Kr laser and developed at 120° C. for 15 seconds as above, they were examined for photographic properties including sensitivity and fog, finding satisfactory results.

Example 2

Sample Nos. 116 to 118 were prepared by the same procedure as sample No. 102 in Example 1 except that the coating solvent was changed from water to a 70/30, 40/60 or 20/80 (weight ratio) mixture of water/methanol. They were examined as in Example 1, with the results shown in Table 2.

TABLE 2

| Sample No. | Photosensitive layer binder Type | Moisture content (wt %) | Organic silver salt dispersion Type | Particle size | Coating solvent | Coating surface quality | Silver tone |
|---|---|---|---|---|---|---|---|
| 116 | LACSTAR 3307B | 0.6 | B | 5.0 μm | water/methanol = 70/30 | ⊙ | ⊙ |
| 117 | LACSTAR 3307B | 0.6 | B | 5.0 μm | water/methanol = 40/60 | ○ | ⊙ |
| 118 | LACSTAR 3307B | 0.6 | B | 5.0 μm | water/methanol = 20/80 | X | ⊙ |

As is evident from Table 2, coating surface quality is improved by using an aqueous solvent containing at least 30% by weight of water and significantly improved by using an aqueous solvent containing at least 70% by weight of water. The advantages of the invention become more significant when coating is done from aqueous solvent systems, which is advantageous from the standpoints of environment and cost.

Example 3

Silver halide trains A

In 700 ml of water were dissolved 22 grams of phthalated gelatin and 30 mg of potassium bromide. The solution was adjusted to pH 5.0 at a temperature of 40° C. To the solution, 159 ml of an aqueous solution containing 18.6 grams of silver nitrate and an aqueous solution containing potassium bromide and potassium iodide in a molar ratio of 92:8 were added over 10 minutes by the controlled double jet method while maintaining the solution at pAg 7.7. Then, 476 ml of an aqueous solution containing 55.4 grams of silver nitrate and an aqueous solution containing 8 μmol/liter of dipotassium hexachloroiridate and 1 mol/liter of potassium bromide were added over 30 minutes by the controlled double jet method while maintaining the solution at pAg 7.7. The pH of the solution was lowered to cause flocculation and sedimentation for desalting. The solution was adjusted to pH 5.9 and pAg 8.0 by adding 0.1 gram of phenoxyethanol. There were obtained cubic grains having a silver iodide content of 8 mol % in the core and 2 mol % on the average, a mean grain size of 0.07 μm, a coefficient of variation of the projected area diameter of 8%, and a (100) face proportion of 86%.

The thus obtained silver halide grains were heated at 60° C., to which 85 μmol of sodium thiosulfate, 11 μmol of 2,3,4,5,6-pentafluorophenyldiphenylphosphine selenide, 2 μmol of Tellurium compound 1, 3.3 μmol of chloroauric acid, and 230 μmol of thiocyanic acid were added per mol of silver. The solution was ripened for 120 minutes. Thereafter, the temperature was changed to 50° C. and with stirring, $5\times10^{-4}$ mol of Sensitizing dye A and $2\times10^{-4}$ mol of Sensitizing dye B were added, both per mol of the silver halide. Potassium iodide was further added in an amount of 3.5 mol % based on the moles of silver. The emulsion was stirred for 30 minutes and then quenched to 30° C., completing the preparation of silver halide grains A.

Sensitizing dyes A and B and Tellurium compound 1 have the following structure.

Sensitizing dye A

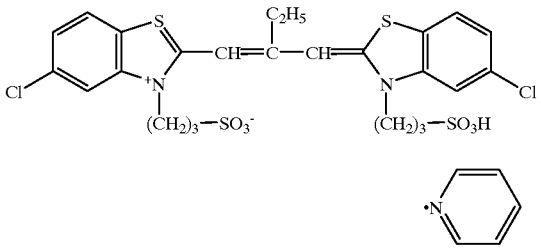

Sensitizing dye B

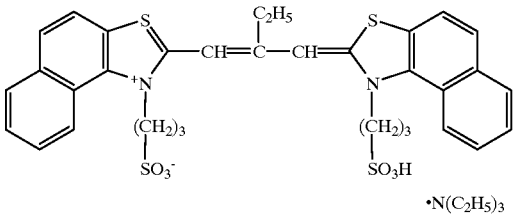

Tellurium compound 1

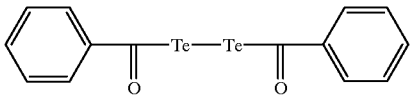

Microcrystalline dispersion A of organic acid silver salt

A mixture of 40 grams of behenic acid, 7.3 grams of stearic acid, and 500 ml of distilled water was stirred ar 90° C. for 15 minutes. 187 ml of 1N NaOH aqueous solution was added to the solution over 15 minutes and 61 ml of 1N nitric acid aqueous solution was added to the solution, which was cooled to 50° C. Next, 124 ml of 1N silver nitrate aqueous solution was added to the solution over 2 minutes, and agitation was continued for a further 30 minutes. The solids were separated by suction filtration and washed with water until the water filtrate reached a conductivity of 30 $\mu$S/cm. The thus collected solids were handled as wet cake without drying. To an amount of the wet cake corresponding to 34.8 grams of dry solids, 12 grams of polyvinyl alcohol and 150 ml of water were added. A slurry was obtained by thorough agitation. The slurry was admitted into a vessel together with 840 grams of zirconia beads having a mean diameter of 0.5 mm. Dispersion was done for 5 hours by means of a dispersing machine (1/4G sand grinder mill by Imex K.K.), completing the preparation of an organic acid silver microcrystalline dispersion of needle grains having a mean minor diameter of 0.04 $\mu$m, a mean major diameter of 0.8 $\mu$m, and a coefficient of variation of the projected area diameter of 30% as observed under an electron microscope.

Solid Particle dispersions 1 and 2 of reducing agent

To 10 grams of Reducing agent 1 or 2 were added 4 grams of hydroxypropyl cellulose and 86 grams of water. They were thoroughly agitated into a slurry, which was allowed to stand for 10 hours. A vessel was charged with the slurry along with 168 grams of zirconia beads having a mean diameter of 0.5 mm. A dispersing machine as used above was operated for 10 hours. There were obtained solid particle dispersions 1 and 2 of Reducing agents 1 and 2, respectively. Those particles having a diameter of 0.4 to 1.0 $\mu$m accounted for 70% by weight of the dispersed particles.

Reducing agent 1

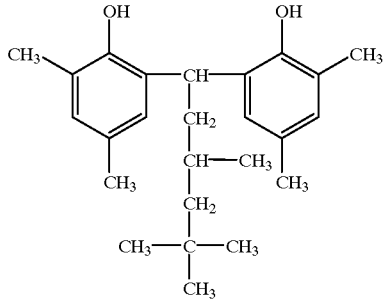

Reducing agent 2

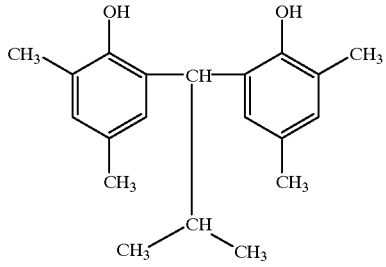

Solid particle dispersions 3 and 4 of reducing agent

To ethyl acetate was added 4.5 grams of Reducing agent 1 or 2. Stirring assisted in dissolving the reducing agent in ethyl acetate. A solution of 1.6 grams of polyvinyl alcohol in water was added to the solution, which was agitated at a high speed by a homogenizer. Using an evaporator, the ethyl acetate was then volatilized off. There were obtained solid particle dispersions 3 and 4 of Reducing agents 1 and 2, respectively. Those particles having a diameter of 0.4 to 1.0 $\mu$m accounted for 70% by weight of the dispersed particles.

Emulsion layer coating solution

An emulsion coating solution was prepared by adding silver halide grains A in an amount of 10 mol % of silver halide based on the moles of organic acid silver, a binder and chemical addenda (shown below) to the above-prepared organic acid silver microcrystalline dispersion (equivalent to 1 mol of silver).

Binder (see Table 3) 430 g

Toner 1 (as methanol solution) 9.2g

Toner 2 (as methanol solution) 6.7 g

Tribromomethylphenylsulfone 12 g

Reducing agent 1 98 g

It is noted that for coated sample Nos. 206 to 213, 80 grams of Reducing agent 2 was added instead of Reducing agent 1.

Toner 1

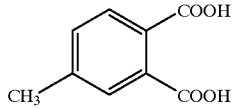

-continued

Toner 2

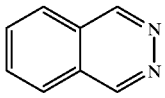

Note that among the binders used herein, LACSTAR 3307B and 7132C are polymer latices of a styrene-butadiene copolymer whose dispersed particles have a mean particle size of 110 nm and 260 nm, respectively.

The reducing agent was added as a solution in a solvent or a solid particle dispersion as shown in Table 3. The toners were added as a solution in methanol.

Emulsion surface protective layer coating solution

A surface protective layer coating solution was prepared by mixing 10 grams of inert gelatin with 0.26 gram of Surfactant A, 0.09 gram of Surfactant B, 0.9 gram of silica particles with a mean particle size of 2.5 $\mu$m, 0.3 gram of 1,2-bis(vinylsulfonylacetamido)ethane, and 64 grams of water.

Surfactant A

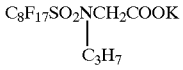

Surfactant B

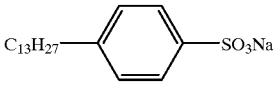

Color developing agent dispersion

To 35 grams of ethyl acetate were added 2.5 grams of Compound 1 and 7.5 grams of Compound 2. The mixture was agitated for dissolution. The solution was combined with 50 grams of a 10 wt % polyvinyl alcohol solution and agitated for 5 minutes by means of a homogenizer. Thereafter, the ethyl acetate was volatilized off for solvent removal purpose. Dilution with water yielded a color developing agent dispersion.

Compound 1

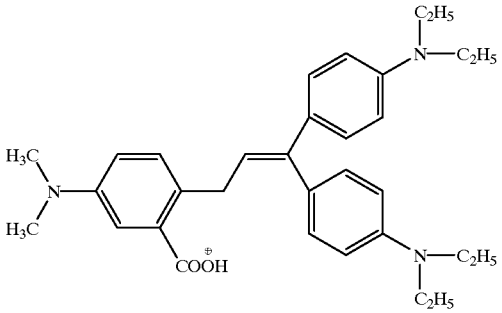

Compound 2

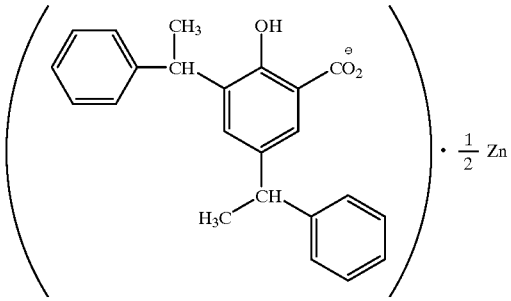

Back surface coating solution

A back surface coating solution was prepared by adding 50 grams of the color developing agent dispersion, 20 grams of Compound 3, 250 grams of water, and 1.8 grams of Sildex H121 spherical silica having a mean particle size of 12 $\mu$m to 30 grams of polyvinyl alcohol.

Compound 3

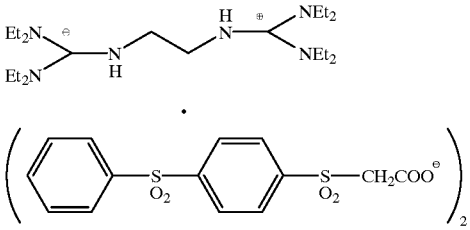

Coated sample Nos. 202 to 213

The emulsion layer coating solution prepared above was coated onto a polyethylene terephthalate support of 175 $\mu$m thick tinted with a blue dyestuff so as to give a silver coverage of 1.9 g/m$^2$. The emulsion surface protective layer coating solution was simultaneously coated onto the emulsion coating so as to give a binder coverage of 1.8 g/m$^2$. After drying, the back surface coating solution was coated onto the surface of the support opposite to the emulsion layer so as to give an optical density of 0.7 at 660 nm, obtaining photothermographic materials, coated sample Nos. 202 to 213.

Coated sample No. 201

To 300 ml of water was added 10.6 grams of behenic acid. The mixture was heated at 90° C. for dissolution. With thorough stirring, 31.1 ml of 1N sodium hydroxide was added to the solution, which was allowed to stand for one hour at the temperature. The solution was then cooled to 30° C., to which 7.0 ml of 1N phosphoric acid was added. With thorough stirring, 0.01 gram of N-bromosuccinimide was added to the solution. Thereafter, while the solution was heated at 40° C. and stirred, the silver halide grains A prepared above were added to the solution so as to give 10 mol % of silver based on the moles of behenic acid. Further, 25 ml of an aqueous solution of 1N silver nitrate was continuously added over 2 minutes to the solution, which was stirred for a further one hour. With stirring, 37 grams of a n-butyl acetate solution of 1.2 wt % polyvinyl acetate was gradually added to the solution to form flocs in the dispersion. Water was removed, and water washing was repeated twice. 20 ml of a solution of 2.5% by weight polyvinyl butyral (molecular weight 3,000) in 2-butanone was added and stirring was continued at an appropriate speed for 10 minutes. Then 70 mg of potassium bromide, 40 grams of 2-butanone, and 6.0 grams of polyvinyl butyral (molecular weight 4,000) were added to the dispersion. Stirring was continued at an appropriate speed for one hour, yielding an organic fatty acid silver emulsion. To the emulsion, solutions of Reducing agent 1, Toners 1 and 2, and tribromomethylphenylsulfone (as added to coated sample No. 202) in methyl ethyl ketone or dimethylformamide were added in the same amounts as in coated sample No. 202. This solution was coated on a support. A protective layer coating solution was prepared by mixing 7.5 grams of cellulose acetate butyrate, 80 grams of 2-butanone, and 10 grams of methanol and coated on the emulsion layer in such an amount as to give 2.5 g/m$^2$ of cellulose acetate butyrate. Back surface coating was the same as in coated sample No. 202. A coated sample No. 201 was obtained in this way.

For sample Nos. 201 to 213, the binders used in their photosensitive layer were measured for equilibrium moisture content. The samples were examined for photographic properties, natural aging stability, coating surface quality and silver tone by the following methods.

Measurement of moisture content of binder

A solution or dispersion of the polymer used in the emulsion layer was coated on a glass plate and dried at 50° C. for one hour to form a model polymer film of 100 $\mu$m thick. When two or more polymers were used as a binder in the layer, a sample was prepared by mixing these polymers in the same ratio as in that layer. The model polymer film was stripped from the glass plate and allowed to stand at 25° C. and RH 60% for 3 days before its weight (W1) was measured. The model polymer film was then allowed to stand at 25° C. in vacuum for 3 days. Immediately thereafter, the film was placed in a weighing bottle having a known weight (W2). From the weight (W3) of the bottle, the weight of the dry polymer film was calculated (W0=W3−W2). The equilibrium moisture content (Weq) at 25° C. and RH 60% of the polymer was calculated according to the equation: Weq=(W1−W0) /W0×100% by weight.

Photographic properties

A coated sample was exposed at an incident angle of 30° by means of a laser sensitometer equipped with a 647-nm Kr laser (maximum power 500 mW) and developed at 120° C. for 20 seconds. The image was examined for Dmin and sensitivity by a densitometer. The sensitivity (S) is the reciprocal of a ratio of an exposure providing a density higher by 1.0 than Dmin and expressed in a relative value based on a sensitivity of 100 for coated sample No. 202.

Natural aging stability

A coated sample was cut into sections of 30.5 cm×25.4 cm with round corners having an inner radius of 0.5 cm. The sample sheet was kept in an atmosphere of 25° C. and RH 50% for one day. Each sample sheet was placed in a moisture-proof bag, which was sealed and placed in a decorative box of 35.1 cm×26.9 cm×3.0 cm. In this condition, the sheet was aged for 5 days at 50° C. (forced aging test). The aged sheet was processed as in the photographic test and measured for Dmin.

Coating surface quality

A coated sample was visually observed and rated "○" when the surface quality was practically acceptable and "X" when the surface quality was poor and practically unacceptable.

Silver tone after processing

A coated sample was processed as in the photographic test and the tone of a maximum density area was evaluated.

The results are shown in Table 3.

Note that coated sample No. 201 was prepared using methyl ethyl ketone as the solvent for the reducing agent-containing layer.

TABLE 3

| Coated sample | Binder | Moisture content (%) | Reducing agent | Reducing agent adding manner |
|---|---|---|---|---|
| 201 (comparison) | polyvinyl butyral | 1.0 | 1 | acetone |
| 202 | LACSTAR 3307B | 0.6 | 1 | acetone |
| 203 | LACSTAR 3307B | 0.6 | 1 | dimethyl-formamide |
| 204** | LACSTAR 3307B | 0.6 | 1 | solid particle dispersion 1 |
| 205** | LACSTAR 3307B | 0.6 | 1 | solid particle dispersion 3 |
| 206 | LACSTAR 3307B | 0.6 | 2 | acetone |
| 207 | LACSTAR 3307B | 0.6 | 2 | dimethyl-formamide |
| 208** | LACSTAR 3307B | 0.6 | 2 | solid particle dispersion 2 |
| 209** | LACSTAR 3307B | 0.6 | 2 | solid particle dispersion 4 |
| 210** | LACSTAR 7132C | 0.4 | 2 | solid particle dispersion 4 |
| 211 (comparison) | polyvinyl alcohol* | 4.2 | 2 | solid particle dispersion 4 |
| 212 (comparison) | gelatin (ion exchanged) | 10.0 | 2 | solid particle dispersion 4 |
| 213 (comparison) | gelatin (non-ion-exchanged) | 10.0 | 2 | solid particle dispersion 4 |

| Coated sample | Ease of coating | Photographic properties D min. | Photographic properties S | Natural aging stability, D min. | Surface quality | Image tone |
|---|---|---|---|---|---|---|
| 201 (comparison) | difficult | 0.06 | 94 | 0.10 | ○ | black |
| 202 | easy | 0.07 | 100 | 0.11 | X | black |
| 203 | easy | 0.19 | 105 | 0.27 | X | black |
| 204** | easy | 0.05 | 110 | 0.09 | ○ | black |
| 205** | easy | 0.05 | 110 | 0.09 | ○ | black |
| 206 | easy | 0.06 | 101 | 0.13 | X | black |
| 207 | easy | 0.26 | 106 | 0.36 | X | black |
| 208** | easy | 0.06 | 118 | 0.08 | ○ | black |
| 209** | easy | 0.06 | 115 | 0.08 | ○ | black |
| 210** | easy | 0.06 | 116 | 0.07 | ○ | black |
| 211 (comparison) | easy | 0.09 | 90 | 0.11 | ○ | brown |
| 212 (comparison) | easy | 0.18 | 18 | 0.89 | ○ | brown |
| 213 (comparison) | easy | 0.16 | 15 | 0.76 | ○ | brown |

*Poval PVA205 by Kurare K.K.
**preferred embodiment

As is evident from Table 3, coated sample No. 201 showed fairly good properties although the coating solution using an organic solvent was difficult to handle. Coated sample Nos. 202 to 213 showed good properties because the coating solution was based on an aqueous solvent and among others, coated sample Nos. 202 to 210 showed favorable black image tone. Coated sample Nos. 204, 205, 208, 209 and 210 having good coating surface quality, excellent photographic properties, natural aging stability, and favorable black image tone were obtained by adding the reducing agent in the from of a solid microcrystalline dispersion and using a binder polymer having a moisture content of up to 2% by weight.

Example 4

Solid particle dispersion 1 of toner

To 93 grams of water were added 2.9 grams of Toner 1, 2.1 grams of Toner 2, and 2 grams of hydroxypropyl cellulose. After thorough stirring, the slurry was allowed to stand for 10 hours. A vessel was charged with the slurry together with 168 grams of zirconia beads having a mean diameter of 0.5 mm. A dispersing machine as used in the preparation of the microcrystalline dispersion of the reducing agent was operated for 10 hours for dispersion, obtaining a solid particle dispersion 1 of Toners 1 and 2 in which particles with a diameter of 0.5 to 1.0 μm accounted for 70% by weight.

Solid Particle dispersion 2 of toner

To ethyl acetate were added 2.9 grams of Toner 1 and 2.1 grams of Toner 2. They were stirred for dissolution and a solution of 1.6 grams polyvinyl alcohol in water was added thereto. The mixture was agitated at a high speed by means of a homogenizer. Then the ethyl acetate was volatilized off, obtaining a solid particle dispersion 2 of Toners 1 and 2 in which particles with a diameter of 0.5 to 1.0 μm accounted for 70% by weight.

Solid particle dispersion 3 of toner

To 88 grams of water were added 4.9 grams of Toner 1, 3.6 grams of Toner 2, 1.5 grams of Toner 3 (shown below), and 2 grams of hydroxypropyumethyl cellulose. After thorough stirring, the slurry was allowed to stand for 10 hours. A vessel was charged with the slurry together with 168 grams of zirconia beads having a mean diameter of 0.5 mm. A dispersing machine as used in the preparation of the solid particle dispersion 1 was operated for 10 hours for dispersion, obtaining a toner solid particle dispersion 3 in which particles with a diameter of 0.5 to 1.0 μm accounted for 70% by weight.

Toner 3

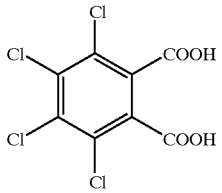

Solid particle dispersions 4–6 of toner

Solid particle dispersions 4, 5 and 6 separately containing Toners 1, 2 and 3 were prepared by the same procedure as the solid particle dispersion 3. The particle diameter was the same as in the solid particle dispersion 3.

Coated samples were prepared as in Example 3. It is understood from Table 4 that the toner was added either as a solution in a solvent or as a solid particle dispersion. In coated sample No. 224, a mixture of the toner solid particle dispersions 4, 5 and 6 was used. The reducing agent used was the reducing agent solid particle dispersion 1.

The coated samples were examined as in Example 3, with the results shown in Table 4. With respect to natural aging stability, the samples were measured for not only Dmin, but also sensitivity. The sensitivity (S) is expressed in a relative value based on a sensitivity of 100 for coated sample No. 215 before aging.

TABLE 4

| Coated sample | Binder | Moisture content (%) | Toner | Toner adding manner |
|---|---|---|---|---|
| 214 (comparison) | polyvinyl alcohol* | 4.2 | 1,2 | water |
| 215 (invention) | LACSTAR 3307B | 0.6 | 1,2 | water |
| 216 (invention) | LACSTAR 3307B | 0.6 | 1,2 | methanol |
| 217 (invention) | LACSTAR 3307B | 0.6 | 1,2 | solid particle dispersion 1 |
| 218 (invention) | LACSTAR 3307B | 0.6 | 1,2 | solid particle dispersion 2 |
| 219 (invention) | LACSTAR 3307B | 0.6 | 1,2,3 | water/methanol |
| 220 (invention) | LACSTAR 3307B | 0.6 | 1,2,3 | solid particle dispersion 3 |
| 221 (invention) | LACSTAR 7132C | 0.4 | 1,2,3 | solid particle dispersion 3 |
| 222 (comparison) | gelatin (ion exchanged) | 10.0 | 1,2,3 | solid particle dispersion 3 |
| 223 (comparison) | gelatin (non-ion-exchanged) | 10.0 | 1,2,3 | solid particle dispersion 3 |
| 224 (invention) | LACSTAR 3307B | 0.6 | 1,2,3 | solid particle dispersion 4,5,6 (mixture of three dispersions) |

| | Photographic properties | | Natural aging stability | | Surface | |
|---|---|---|---|---|---|---|
| Coated sample | D min. | S | D min. | S | quality | Image tone |
| 214 (comparison) | 0.06 | 95 | 0.15 | 35 | ○ | brown |
| 215 (invention) | 0.06 | 100 | 0.07 | 68 | ○ | black |
| 216 (invention) | 0.06 | 100 | 0.07 | 65 | ○ | black |
| 217 (invention) | 0.05 | 138 | 0.07 | 121 | ○ | black |
| 218 (invention) | 0.05 | 129 | 0.07 | 118 | ○ | black |
| 219 (invention) | 0.06 | 101 | 0.07 | 56 | ○ | black |
| 220 (invention) | 0.05 | 126 | 0.07 | 118 | ○ | black |
| 221 (invention) | 0.05 | 135 | 0.08 | 123 | ○ | black |
| 222 (comparison) | 0.11 | 18 | 0.15 | 7 | ○ | brown |
| 223 (comparison) | 0.10 | 27 | 0.16 | 12 | ○ | brown |
| 224 (invention) | 0.05 | 120 | 0.07 | 103 | ○ | black |

*Poval PVA205 by Kurare K.K.

It is evident from Table 4 that high sensitivity and minimal desensitization of naturally aged photographic properties are accomplished by using the toner as a solid particle dispersion. It is also seen that better results are obtained when two or more toners are used as a common solid particle dispersion.

Example 5

Coated samples were prepared and examined as in Example 3 except for the following changes. Silver halide grains A were replaced by silver halide grains B which were prepared by the same procedure as silver halide grains A in Example 3 except that Sensitizing dyes C and D (shown below) were used instead of Sensitizing dyes A and B. The coated samples were examined for photographic properties and natural aging stability using a laser sensitometer equipped with a 820-nm diode instead of the sensitometer used in Example 3. The samples showed the same tendency as in Example 3, demonstrating the benefits attributable to the addition of the reducing agent as a solid particle dispersion.

Sensitizing dye C

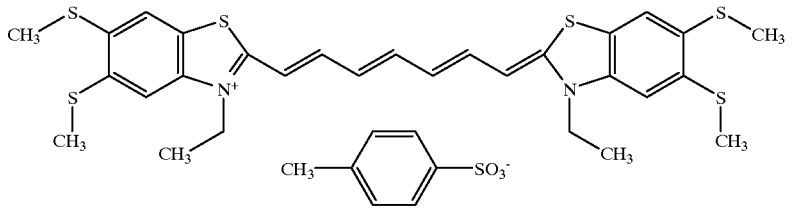

Sensitizing dye D

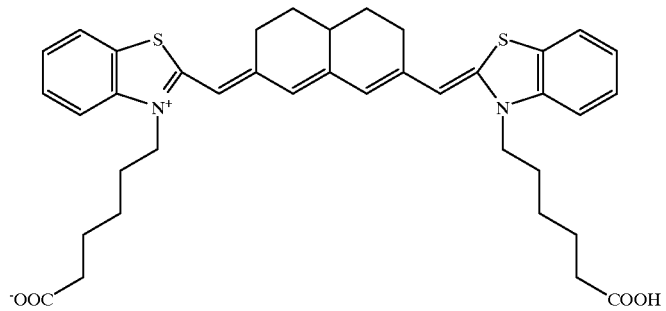

Example 6

Coated samples were prepared as in Example 4 except that Sensitizing dyes C and D were used. They were examined as in Example 5. The samples showed the same tendency as in Example 4, demonstrating the benefits attributable to the addition of the toner as a solid particle dispersion.

Example 7

A coated sample was prepared by the same procedure as coated sample No. 202 in Example 3 except that Toners 1 and 2 were added as the toner solid particle dispersion 1 instead of the methanol solution. Coating surface quality and natural aging stability were improved to the practically acceptable level.

Example 8

Silver halide grains A

In 700 ml of water were dissolved 22 grams of phthalated gelatin and 30 mg of potassium bromide. The solution was adjusted to pH 5.0 at a temperature of 40° C. To the solution, 159 ml of an aqueous solution containing 18.6 grams of silver nitrate and an aqueous solution containing potassium bromide and potassium iodide in a molar ratio of 92:8 were added over 10 minutes by the controlled double jet method while maintaining the solution at pAg 7.7. Then, 476 ml of an aqueous solution containing 55.4 grams of silver nitrate and an aqueous solution containing 8 μmol/liter of dipotassium hexachloroiridate and 1 mol/liter of potassium bromide were added over 30 minutes by the controlled double jet method while maintaining the solution at pAg 7.7. The pH of the solution was lowered to cause flocculation and sedimentation for desalting. The solution was adjusted to pH 5.9 and pAg 8.0 by adding 0.1 gram of phenoxyethanol. There were obtained cubic grains having a silver iodide content of 8 mol % in the core and 2 mol % on the average, a mean grain size of 0.07 μm, a coefficient of variation of the projected area diameter of 8%, and a (100) face proportion of 86%.

The thus obtained silver halide grains were heated at 60° C., to which 85 μmol of sodium thiosulfate, 11 μmol of 2,3,4,5,6-pentafluorophenyldiphenylphosphine selenide, 2 μmol of Tellurium compound 1, 3.3 μmol of chloroauric acid, and 230 μmol of thiocyanic acid were added per mol of silver. The solution was ripened for 120 minutes. Thereafter, the temperature was changed to 50° C. and with stirring, $5\times10^{-4}$ mol of Sensitizing dye A and $2\times10^{-4}$ mol of Sensitizing dye B were added, both per mol of the silver halide. Potassium iodide was further added in an amount of 3.5 mol % based on the moles of silver halide. The emulsion was stirred for 30 minutes and then quenched to 30° C., completing the preparation of silver halide grains A.

Sensitizing dyes A and B and Tellurium compound 1 have the following structure.

Sensitizing dye A

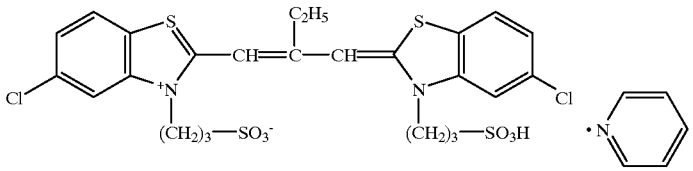

Sensitizing dye B

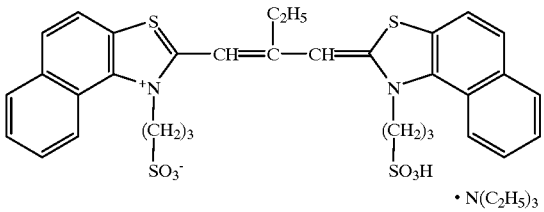

Tellurium compound 1

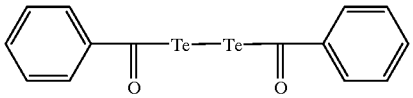

Microcrystalline dispersion A of organic acid silver salt

A mixture of 40 grams of behenic acid, 7.3 grams of stearic acid, and 500 ml of distilled water was stirred at 90° C. for 15 minutes. 187 ml of 1N NaOH aqueous solution was added to the solution over 15 minutes and 61 ml of 1N nitric acid aqueous solution was added to the solution, which was cooled to 50° C. Next, 124 ml of 1N silver nitrate aqueous solution was added to the solution over 2 minutes, and agitation was continued for a further 30 minutes. The solids were separated by suction filtration and washed With water until the water filtrate reached a conductivity of 30 μS/cm. The thus collected solids were handled as wet cake without drying. To an amount of the wet cake corresponding to 34.8 grams of dry solids, 12 grams of polyvinyl alcohol and 150 ml of water were added. A slurry was obtained by thorough agitation. The slurry was admitted into a vessel together with 840 grams of zirconia beads having a mean diameter of 0.5 mm. Dispersion was done for 5 hours by means of a dispersing machine (1/4G sand grinder mill by Imex K.K.), completing the preparation of an organic acid silver microcrystalline dispersion of needle grains having a mean minor diameter of 0.04 μm, a mean major diameter of 0.8 μm, and a coefficient of variation of the projected area of 30% as observed under an electron microscope.

Solid particle dispersion of reducing agent

To 10 grams of Reducing agent 1 were added 4 grams of hydroxypropyl cellulose and 86 grams of water. They were thoroughly agitated into a slurry, which was allowed to stand for 10 hours. A vessel was charged with the slurry along with 168 grams of zirconia beads having a mean diameter of 0.5 mm. A dispersing machine as used above was operated for 10 hours. There was obtained a solid particle dispersion of Reducing agent 1. Those particles having a diameter of up to 1.0 μm accounted for 70% by weight of the dispersed particles.

Reducing agent 1

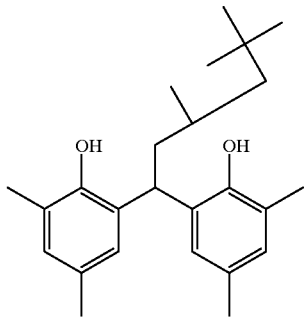

Solid particle dispersion of toner

To 93 grams of water were added 2.9 grams of Toner 1, 2.1 grams of Toner 2, and 2 grams of hydroxypropyl cellulose. After thorough stirring, the slurry was allowed to stand for 10 hours. A vessel was charged with the slurry together with 168 grams of zirconia beads having a mean diameter of 0.5 mm. A dispersing machine as used in the preparation of the microcrystalline dispersion of the reducing agent was operated for 10 hours for dispersion, obtaining a solid particle dispersion of Toners 1 and 2 in which particles with a diameter of up to 1.0 μm accounted for 70% by weight.

Toner 1

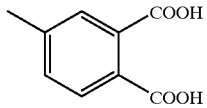

Toner 2

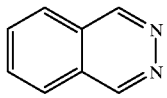

Emulsion layer coating solution

A photosensitive layer coating solution was prepared by adding silver halide grains A in an amount of 10 mol % of silver halide based on the moles of organic acid silver, 430 grams of a binder as shown in Table 5, 12 grams of tribromomethylphenylsulfone, and 98 grams of Reducing agent 1 to the above-prepared organic acid silver microcrystalline dispersion (equivalent to 1 mol of silver).

Intermediate layer coating solution

An intermediate layer coating solution was prepared by adding 10 grams of a binder as shown in Table 5, 0.8 gram of Toner 1, 0.6 gram of Toner 2, and 0.04 gram of Surfactant B to 264 grams of water. In samples wherein no intermediate layer was formed, Toners 1 and 2 were added to the photosensitive layer such that the amounts of Toners 1 and 2 coated were the same as in the samples having the intermediate layer.

Emulsion surface protective layer coating solution

A surface protective layer coating solution was prepared by mixing 10 grams of inert gelatin with 0.26 gram of Surfactant A, 0.09 gram of Surfactant B, 0.9 gram of silica particles with a mean particle size of 2.5 μm, 0.6 gram of 1,2-bis(vinylsulfonylacetamido)ethane, and 64 grams of water.

Surfactant A

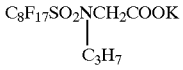

Surfactant B

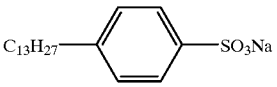

Color developing agent dispersion

To 35 grams of ethyl acetate were added 2.5 grams of Compound 1 and 7.5 grams of Compound 2. The mixture was agitated for dissolution. The solution was combined with 50 grams of a 10 wt % polyvinyl alcohol solution and agitated for 5 minutes by means of a homogenizer. Thereafter, the ethyl acetate was volatilized off for solvent removal purpose. Dilution with water yielded a color developing agent dispersion.

Compound 1

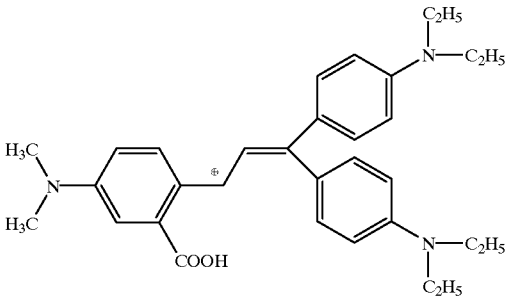

Compound 2

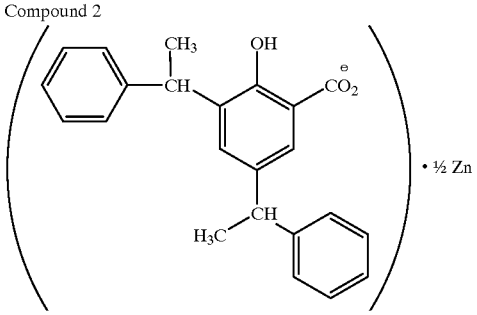

Back surfacecoating solution

A back surface coating solution was prepared by adding 50 grams of the color developing agent dispersion, 20 grams of Compound 3, and 250 grams of water to 30 grams of polyvinyl alcohol.

Compound 3

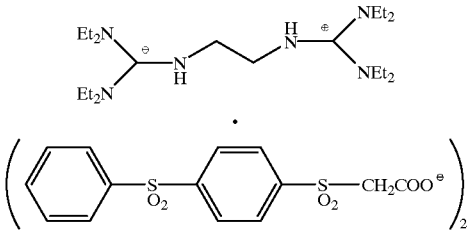

Coated samples

The emulsion layer coating solution prepared above was coated onto a biaxially oriented polyethylene terephthalate support of 175 μm thick tinted with a blue dyestuff so as to give a silver coverage of 1.9 g/m$^2$. The intermediate layer coating solution and the emulsion surface protective layer coating solution were coated onto the emulsion coating so as to give a binder coverage of 1.8 g/m$^2$. The coating procedure used was either a sequential coating procedure of coating and drying the three layers one by one or a co-coating procedure of simultaneously coating and drying the three layers. After coating, samples were kept at 10° C. for one minute and then dried at 50° C. for 20 minutes. After drying, the back surface coating solution was coated onto the surface of the support opposite to the emulsion layer and dried at 50° C. for 20 minutes so as to give an optical density of 0.7 at 660 nm, obtaining coated sample Nos. 301 to 321.

For these samples, the binders used in their photosensitive layer were measured for equilibrium moisture content. The samples were examined for photographic properties, coating surface quality, image tone, and graininess by the following methods.

Measurement of moisture content of binder

A solution or dispersion of the polymer used in the emulsion layer was coated on a glass plate and dried at 50° C. for one hour to form a model polymer film of 100 μm thick. The model polymer film was stripped from the glass plate and allowed to stand at 25° C. and RH 60% for 3 days before its weight (W1) was measured. The model polymer film was then allowed to stand at 25° C. in vacuum for 3 days. Immediately thereafter, the film was placed in a weighing bottle having a known weight (W2). From the weight (W3) of the bottle, the weight of the dry polymer film was calculated (W=0=W3−W2). The equilibrium moisture content (Weq) at 25° C. and RH 60% of the polymer was calculated according to the equation: Weq =(W1−W0)/W0× 100% by weight.

Photographic properties

A coated sample was exposed at an incident angle of 30° by means of a laser sensitometer equipped with a 647-nm Kr laser (maximum power 500 mW) and developed at 120° C. for 20 seconds. The image was examined for Dmin, Dmax, and sensitivity by a densitometer. The sensitivity (S) is the reciprocal of a ratio of an exposure providing a density higher by 1.0 than Dmin and expressed in a relative value based on a sensitivity of 100 for coated sample No. 301.

Coating surface quality

A coated sample was visually observed for surface quality and rated according to the following 4-point scale.

1 satisfactory surface quality 2 satisfactory surface quality in a central portion, but disordered in end portions 3 slightly disordered over the entire region 4 markedly disordered over the entire region Samples rated "1" and "2" are practically acceptable, with the sample rated "1" being most preferred.

Image tone

A coated sample processed as in the photographic test was visually observed to rate the tone of a silver image in a maximum density area according to the following 4-point scale.

1 black 2 slightly brownish black 3 brownish black 4 brown

Samples rated "1" and "2" are practically acceptable, with the sample rated "1" being most preferred.

Graininess

A coated sample processed as in the photographic test was visually observed through a magnifier to rate the graininess of a silver image in a maximum density area according to the following 4-point scale.

1 not rough 2 slightly rough, but on the acceptable level 3 rough 4 apparently perceivable roughness Samples rated "1" and "2" are practically acceptable, with the sample rated "1" being most preferred.

The results are shown in Table 5.

TABLE 5

| Sample No. | Photo-sensitive layer binder | Moisture content (wt %) | Photosensi-tive layer coating procedure | Intermediate layer binder |
|---|---|---|---|---|
| 301 (comparison) | polyvinyl alcohol | 4.0 | sequential | none |
| 302 (comparison) | polyvinyl alcohol | 4.0 | sequential | LACSTAR 3307B |
| 303 (comparison) | polyvinyl alcohol | 4.0 | sequential | polyvinyl alcohol |
| 304 (comparison) | polyvinyl alcohol | 4.0 | sequential | gelatin |
| 305 (comparison) | polyvinyl alcohol | 4.0 | sequential | hydroxypropyl cellulose |
| 306 (comparison) | polyvinyl alcohol | 4.0 | sequential | hydroxypropyl-methyl cellulose |
| 307 | LACSTAR 3307B | 0.6 | sequential | none |
| 308* | LACSTAR 3307B | 0.6 | sequential | LACSTAR 3307B |
| 309* | LACSTAR 3307B | 0.6 | sequential | polyvinyl alcohol |
| 310* | LACSTAR 3307B | 0.6 | sequential | gelatin |
| 311* | LACSTAR 3307B | 0.6 | sequential | hydroxypropyl cellulose |
| 312* | LACSTAR 3307B | 0.6 | sequential | hydroxypropyl-methyl cellulose |
| 313 | LACSTAR 3307B | 0.6 | simultaneous | none |
| 314* | LACSTAR 3307B | 0.6 | simultaneous | LACSTAR 3307B |
| 315* | LACSTAR 3307B | 0.6 | simultaneous | polyvinyl alcohol |
| 316* | LACSTAR 3307B | 0.6 | simultaneous | gelatin |
| 317* | LACSTAR 3307B | 0.6 | simultaneous | hydroxypropyl cellulose |
| 318* | LACSTAR 3307B | 0.6 | simultaneous | hydroxypropyl-methyl cellulose |
| 319* | LACSTAR 3307B | 0.6 | simultaneous | hydroxypropyl-methyl cellulose |
| 320 (comparison) | polyvinyl alcohol | 4.0 | simultaneous | polyvinyl alcohol |
| 321 (comparison) | polyvinyl alcohol | 4.0 | simultaneous | hydroxypropyl cellulose |

| Sample No. | Surface protective layer binder | Surface quality | Graini-ness | Fog | S | Image tone |
|---|---|---|---|---|---|---|
| 301 (comparison) | gelatin | 2 | 1 | 0.32 | 100 | 4 |
| 302 (comparison) | gelatin | 2 | 3 | 0.28 | 130 | 4 |
| 303 (comparison) | gelatin | 2 | 1 | 0.34 | 140 | 4 |
| 304 (comparison) | gelatin | 2 | 1 | 0.33 | 130 | 4 |
| 305 (comparison) | gelatin | 2 | 1 | 0.29 | 130 | 4 |
| 306 (comparison) | gelatin | 2 | 1 | 0.30 | 140 | 4 |
| 307 | gelatin | 2 | 3 | 0.19 | 100 | 1 |
| 308* | gelatin | 2 | 2 | 0.18 | 140 | 1 |
| 309* | gelatin | 2 | 1 | 0.19 | 140 | 2 |
| 310* | gelatin | 2 | 1 | 0.20 | 150 | 2 |
| 311* | gelatin | 2 | 1 | 0.19 | 130 | 2 |
| 312* | gelatin | 2 | 1 | 0.21 | 140 | 2 |
| 313 | gelatin | 1 | 3 | 0.20 | 100 | 1 |
| 314* | gelatin | 1 | 2 | 0.18 | 140 | 1 |
| 315* | gelatin | 1 | 1 | 0.19 | 130 | 2 |
| 316* | gelatin | 1 | 1 | 0.20 | 140 | 2 |
| 317* | gelatin | 1 | 1 | 0.20 | 140 | 2 |
| 318* | gelatin | 1 | 1 | 0.20 | 140 | 2 |
| 319* | hydroxypropyl-methyl cellulose | 2 | 1 | 0.20 | 140 | 2 |
| 320 (comparison) | polyvinyl alcohol | 3 | 1 | 0.33 | 100 | 4 |
| 321 (comparison) | hydroxypropyl cellulose | 3 | 1 | 0.35 | 100 | 4 |

*preferred embodiment

Polyvinyl alcohol: PVA205 by Kurare K.K.

LACSTAR 3370B: SBR latex by Dai-Nihon Ink Chemical Industry K.K.

Hydroxypropyl cellulose: HPC SL by Nihon Soda K.K.

Hydroxypropylmethyl cellulose: 60SH50 by Shin-Etsu Chemical Industry K.K.

Example 9

Coated samples were prepared and examined as in Example 8 except for the following changes. Silver halide grains were prepared as in Example 8 except that Sensitizing dyes C and D (shown below) were used instead of Sensitizing dyes A and B. The coated samples were examined for photographic properties using a laser sensitometer equipped with a 820-nm diode instead of the sensitometer used in Example B. The samples showed the same results as in Example 8.

Sensitizing dye C

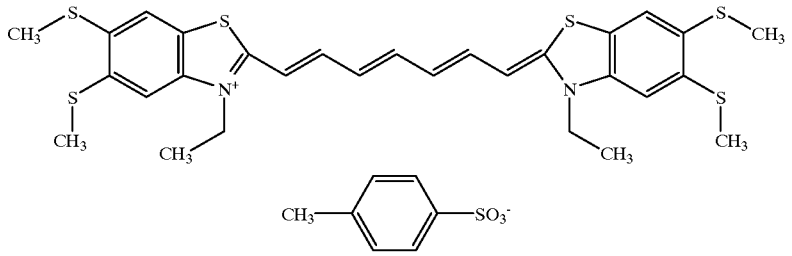

Sensitizing dye D

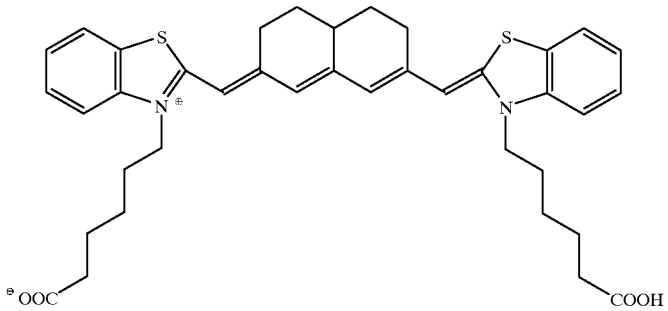

Example 10

Coated samples were prepared as in Example 8 except that the amount of binder coated in the intermediate layer of sample Nos. 314 to 318 in Example 8 was changed from 1.8 g/m$^2$ to 0.15, 0.3, 0.5, 1.0, 3.0, and 5.0 g/m$^2$. The samples showed the same results as in Example 8.

The results of Examples 8 to 10 demonstrate the benefits owing to the formation of the intermediate layer. That is, samples according to the preferred embodiment of the invention are improved in surface quality, photographic properties, image tone, and graininess.

Example 11

Silver halide grains A

In 700 ml of water were dissolved 22 grams of phthalated gelatin and 30 mg of potassium bromide. The solution was adjusted to pH 5.0 at a temperature of 40°°C. To the solution, 159 ml of an aqueous solution containing 18.6 grams of silver nitrate and an aqueous solution containing potassium bromide and potassium iodide in a molar ratio of 92:8 were added over 10 minutes by the controlled double jet method while maintaining the solution at pAg 7.7. Then, 476 ml of an aqueous solution containing 55.4 grams of silver nitrate and an aqueous solution containing 8 $\mu$mol/liter of dipotassium hexachloroiridate and 1 mol/liter of potassium bromide were added over 30 minutes by the controlled double jet method while maintaining the solution at pAg 7.7. The pH of the solution was lowered to cause flocculation and sedimentation for desalting. The solution was adjusted to pH 5.9 and pAg 8.0 by adding 0.1 gram of phenoxyethanol. There were obtained cubic grains having a silver iodide content of 8 mol % in the core and 2 mol % on the average, a mean grain size of 0.07 $\mu$m, a coefficient of variation of the projected area diameter of 8%, and a (100) face proportion of 86%.

The thus obtained silver halide grains were heated at 60° C., to which 85 Umol of sodium thiosulfate, 11 $\mu$mol of 2,3,4,5,6-pentafluorophenyldiphenylphosphine selenide, 2 $\mu$mol of Tellurium compound 1, 3.3 $\mu$mol of chloroauric acid, and 230 $\mu$mol of thiocyanic acid were added per mol of silver. The solution was ripened for 120 minutes. Thereafter, the temperature was changed to 500C and with stirring, $5\times10^{-4}$ mol of Sensitizing dye A and $2\times10^{-4}$ mol of Sensitizing dye B were added, both per mol of the silver halide. Potassium iodide was further added in an amount of 3.5 mol % based on the moles of silver halide. The emulsion was stirred for 30 minutes and then quenched to 30° C., completing the preparation of silver halide grains A.

Sensitizing dyes A and B and Tellurium compound 1 have the following structure.

Sensitizing dye A

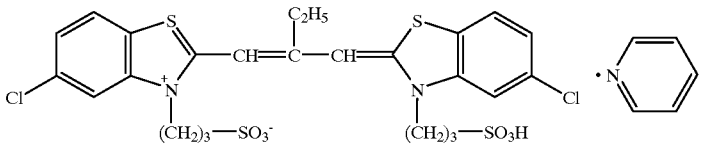

Sensitizing dye B

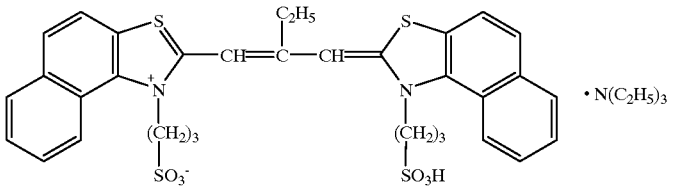

Tellurium compound 1

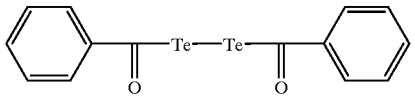

Microcrystalline dispersion A of organic acid silver salt

A mixture of 40 grams of behenic acid, 7.3 grams of stearic acid, and 500 ml of distilled water was stirred at 90° C. for 15 minutes. 187 ml of 1N NaOH aqueous solution was added to the solution over 15 minutes and 61 ml of 1N nitric acid aqueous solution was added to the solution, which was cooled to 50° C. Next, 124 ml of 1N silver nitrate aqueous solution was added to the solution over 2 minutes, and agitation was continued for a further 30 minutes. The solids were separated by suction filtration and washed with water until the water filtrate reached a conductivity of 30 $\mu$S/cm. The thus collected solids were handled as wet cake without drying. To an amount of the wet cake corresponding to 34.8 grams of dry solids, 12 grams of polyvinyl alcohol and 150 ml of water were added. A slurry was obtained by thorough agitation. The slurry was admitted into a vessel together with 840 grams of zirconia beads having a meat diameter of 0.5 mm. Dispersion was done for 5 hours by means of a dispersing machine (1/4G sand grinder mill by Imex K.K.), completing the preparation of an organic acid silver microcrystalline dispersion of needle grains having a mean minor diameter of 0.04 $\mu$m, a mean major diameter of 0.8 $\mu$m, and a coefficient of variation of the projected area of 30% as observed under an electron microscope.

Solid particle dispersion of reducing agent

To 10 grams of Reducing agent 1 were added 4 grams of hydroxypropyl cellulose and 86 grams of water. They were thoroughly agitated into a slurry, which was allowed to stand for 10 hours. A vessel was charged with the slurry along with 168 grams of zirconia beads having a mean diameter of 0.5 mm. A dispersing machine as used above was operated for 10 hours. There was obtained a solid particle dispersion of Reducing agent 1. Those particles having a diameter of up to 1.0 $\mu$m accounted for 70% by weight of the dispersed particles.

Reducing agent 1

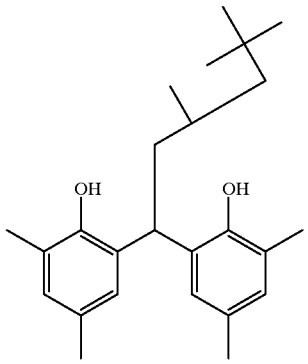

solid Particle dispersion of toner

To 93 grams of water were added 2.9 grams of Toner 2.1 grams of Toner 2, and 2 grams of hydroxypropyl cellulose. After thorough stirring, the slurry was allowed to stand for 10 hours. A vessel was charged with the slurry together with 168 grams of zirconia beads having a mean diameter of 0.5 mm. A dispersing machine as used in the preparation of the microcrystalline dispersion of the reducing agent was operated for 10 hours for dispersion, obtaining a solid particle dispersion of Toners 1 and 2 n which particles with a diameter of up to 1.0 $\mu$m accounted for 70% by weight.

Toner 1

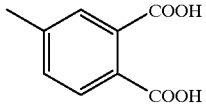

Toner 2

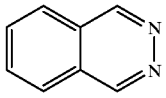

Photosensitive layer coating solution

A photosensitive layer coating solution was prepared by adding silver halide grains A in an amount of 10 mol % of silver halide based on the moles of organic acid silver, a polymer latex and chemical addenda (shown below) to the above-prepared organic acid silver microcrystalline dispersion (equivalent to 1 mol of silver).

LACSTAR 3307B SBR latex 430 g

Tribromomethylphenylsulfone 12 g

Reducing agent 1 98 g

Emulsion surface protective layer coating solution

A surface protective layer coating solution was prepared by mixing 10 grams of inert gelatin with 0.26 gram of Surfactant A, 0.09 gram of Surfactant B, 0.9 gram of silica particles with a mean particle size of 2.5 μm, a crosslinking agent whose type and amount are shown in Table 6, and 164 grams of water.

Surfactant A

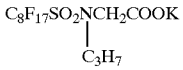

Surfactant B

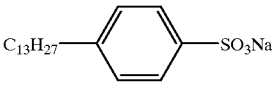

Color developing agent dispersion

To 35 grams of ethyl acetate were added 2.5 grams of Compound 1 and 7.5 grams of Compound 2. The mixture was agitated for dissolution. The solution was combined with 50 grams of a 10 wt % polyvinyl alcohol solution and agitated for 5 minutes by means of a homogenizer. Thereafter, the ethyl acetate was volatilized off for solvent removal purpose. Dilution with water yielded a color developing agent dispersion.

Compound 1

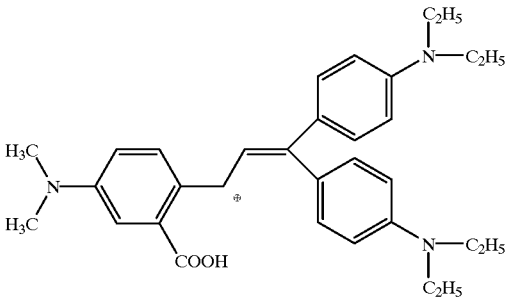

Compound 2

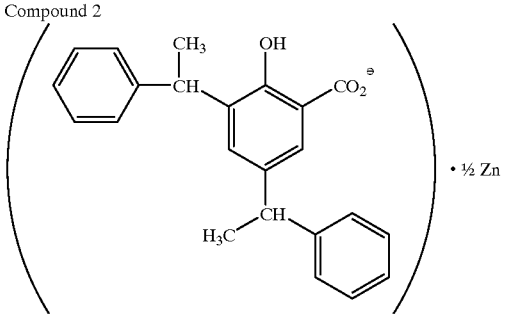

Back surface coating solution

A back surface coating solution was prepared by adding 50 grams of the color developing agent dispersion, 20 grams of Compound 3, and 250 grams of water to 30 grams of polyvinyl alcohol.

Compound 3

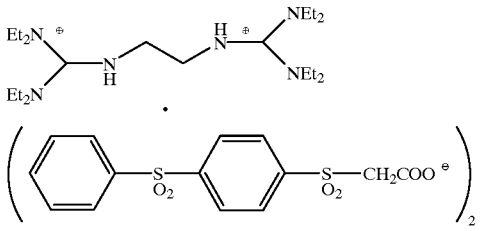

Back surface protective layer coating solution

A back surface protective layer coating solution was prepared by mixing 10 grams of inert gelatin with 0.26 gram of Surfactant A, 0.09 gram of Surfactant B, 0.7 gram of silica particles with a mean particle size of 12 μm, a crosslinking agent whose type and amount are shown in Table 6, and 164 grams of water.

Coated samples

The emulsion layer coating solution prepared above was coated onto a biaxially oriented polyethylene terephthalate support of 175 μm thick tinted with a blue dyestuff so as to give a silver coverage of 1.9 g/m$^2$. The emulsion surface protective layer coating solution was coated onto the emulsion coating so as to give a binder coverage of 1.8 g/m$^2$. The coating procedure used was either a sequential coating procedure of coating and drying the two layers one by one or a co-coating procedure of simultaneously coating and drying the two layers. After coating, samples were kept at 10° C. for one minutes and then dried at 50° C. for 20 minutes. After drying, the back surface coating solution was coated onto the surface of the support opposite to the emulsion layer so as to give an optical density of 0.7 at 660 nm, and the back surface protective layer coating solution was coated thereon to give a binder coverage of 1.8 g/m$^2$. These two back layers were simultaneously coated, kept at 10° C. for one minutes, and dried at 50° C. for 20 minutes, obtaining coated sample Nos. 401 to 414.

For these samples, the binders used in their photosensitive layer were measured for equilibrium moisture content. The samples were stored in an atmosphere of 25° C. and RH 60% for 10 days before they were examined for photographic properties, coating surface quality, image tone, and water resistance by the following methods.

Measurement of moisture content of binder

A solution or dispersion of the polymer used in the emulsion layer was coated on a glass plate and dried at 50° C. for one hour to form a model polymer film of 100 μm thick. The model polymer film was stripped from the glass plaze and allowed to stand at 25° C. and RH 60% for 3 days before its weight (W1) was measured. The model polymer film was then allowed to stand at 25° C. in vacuum for 3 days. Immediately thereafter, the film was placed in a weighing bottle having a known weight (W2). From the weight (W3) of the bottle, the weight of the dry polymer film was calculated (W0=W3−W2). The equilibrium moisture content (Weq) at 25° C. and RH 60% of the polymer was calculated according to the equation: Weq=(W1−W0)/W0×100% by weight.

Photographic properties

A coated sample was exposed at an incident angle of 30° by means of a laser sensitometer equipped with a 647-nm Kr laser (maximum power 500 mW) and developed at 120° C. for 20 seconds. The image was examined for Dmin, Dmax, and sensitivity by a densitometer. The sensitivity (S) is the reciprocal of a ratio of an exposure providing a density higher by 1.0 than Dmin and expressed in a relative value based on a sensitivity of 100 for coated sample No. 401.

Image tone

A coated sample processed as in the photographic test was visually observed to rate the tone of a silver image in a maximum density area according to the following 4-point scale.

1 black 2 slightly brownish black 3 brownish black 4 brown

Samples rated "1" and "2" are practically acceptable, with the sample rated "1" being most preferred.

Coating surface quality

A coated sample was visually observed for surface quality and rated according to the following 4-point scare.

1 satisfactory surface quality 2 satisfactory surface quality in a central portion, but disordered in end portions 3 slightly disordered over the entire region 4 markedly disordered over the entire region Samples rated "1" and "2" are practically acceptable, with the sample rated "1" being most preferred. Observation was made on both the photosensitive layer side and the back side.

Water resistance

On the surface of a coated sample processed as in the photographic test, 0.2 ml of distilled water was dropped and after 1 minute, wiped off with gauze. The water applied area of the sample was visually observed and rated according to the following 4-point scale.

1 substantially unperceivable track of a droplet 2 faintly perceivable track of a droplet 3 perceivable concave track of a droplet 4 the surface protective layer where a droplet had resided was lost The results are shown in Table 6.

TABLE 6

| Sample No. | Photosensitive layer binder | Moisture content (wt %) | Photosensitive layer coating procedure | Crosslinking agent in surface protective layer |
|---|---|---|---|---|
| 401 | LACSTAR 3307B | 0.6 | sequential | none |
| 402* | LACSTAR 3307B | 0.6 | sequential | H-5 (0.9% based on gelatin) |
| 403* | LACSTAR 3307B | 0.6 | sequential | H-5 (1.9% based on gelatin) |
| 404* | LACSTAR 3307B | 0.6 | sequential | H-5 (3.8% based on gelatin) |
| 405* | LACSTAR 3307B | 0.6 | sequential | H-6 (1.6% based on gelatin) |
| 406* | LACSTAR 3307B | 0.6 | sequential | H-6 (3.3% based on gelatin) |
| 407* | LACSTAR 3307B | 0.6 | sequential | H-6 (6.6% based on gelatin) |
| 408 | LACSTAR 3307B | 0.6 | simultaneous | none |
| 409* | LACSTAR 3307B | 0.6 | simultaneous | H-5 (0.9% based on gelatin) |
| 410* | LACSTAR 3307B | 0.6 | simultaneous | H-5 (1.9% based on gelatin) |
| 411* | LACSTAR 3307B | 0.6 | simultaneous | H-5 (3.8% based on gelatin) |
| 412* | LACSTAR 3307B | 0.6 | simultaneous | H-6 (1.6% based on gelatin) |
| 413* | LACSTAR 3307B | 0.6 | simultaneous | H-6 (3.3% based on gelatin) |
| 414* | LACSTAR 3307B | 0.6 | simultaneous | H-6 (6.6% based on gelatin) |

TABLE 6-continued

| Sample No. | Water resistance on photosensitive layer side | Crosslinking agent in back surface protective layer | Water resistance on back layer side | Surface quality | Fog | S | Image tone |
|---|---|---|---|---|---|---|---|
| 401 | 4 | none | 4 | 2 | 0.19 | 100 | 1 |
| 402* | 2 | H-5 (0.9% based on gelatin) | 2 | 2 | 0.22 | 100 | 1 |
| 403* | 1 | H-5 (1.9% based on gelatin) | 1 | 2 | 0.21 | 105 | 1 |
| 404* | 1 | H-5 (3.8% based on gelatin) | 1 | 2 | 0.19 | 100 | 1 |
| 405* | 1 | H-6 (1.6% based on gelatin) | 1 | 2 | 0.19 | 100 | 1 |
| 406* | 1 | H-6 (3.3% based on gelatin) | 1 | 2 | 0.21 | 100 | 1 |
| 407* | 1 | H-6 (6.6% based on gelatin) | 1 | 2 | 0.19 | 100 | 1 |
| 408 | 4 | none | 4 | 1 | 0.18 | 100 | 1 |
| 409* | 2 | H-5 (0.9% based on gelatin) | 2 | 1 | 0.19 | 105 | 1 |
| 410* | 1 | H-5 (1.9% based on gelatin) | 1 | 1 | 0.20 | 100 | 1 |
| 411* | 1 | H-5 (3.8% based on gelatin) | 1 | 1 | 0.19 | 100 | 1 |
| 412* | 1 | H-6 (1.6% based on gelatin) | 1 | 1 | 0.21 | 100 | 1 |
| 413* | 1 | H-6 (3.3% based on gelatin) | 1 | 1 | 0.20 | 105 | 1 |
| 414* | 1 | H-6 (6.6% based on gelatin) | 1 | 1 | 0.18 | 100 | 1 |

*preferred embodiment

Example 12

Coated samples were prepared and examined as in Example 11 except for the following changes. Silver halide grains were prepared as in Example 11 except that Sensitizing dyes C and D (shown below) were used instead of Sensitizing dyes A and B. The coated samples were examined for photographic properties using a laser sensitometer equipped with a 820-nm diode instead of the sensitometer used in Example 11. The samples showed the same results as in Example 11.

Sensitizing dye C

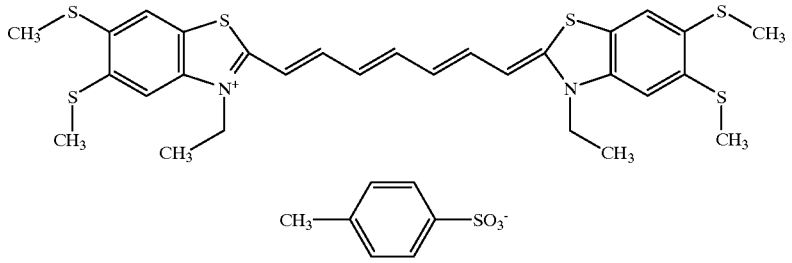

Sensitizing dye D

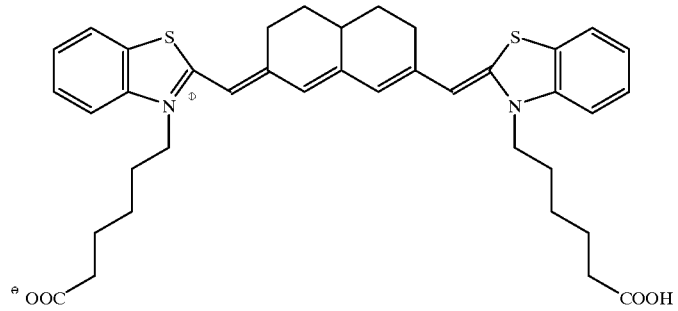

The results of Examples 11 and 12 demonstrate the benefits owing to the addition of the crosslinking agent to the surface protective layer. That is, samples according to the preferred embodiment of the invention are improved in water resistance, surface quality, photographic properties, and image tone.

Example 13

Silver halide grains A

In 700 ml of water were dissolved 22 grams of phthalated gelatin and 30 mg of potassium bromide. The solution was adjusted to pH 5.0 at a temperature of 40° C. To the solution, 159 ml of an aqueous solution containing 18.6 grams of silver nitrate and an aqueous solution containing potassium bromide and potassium iodide in a molar ratio of 92:8 were added over 10 minutes by the controlled double jet method while maintaining the solution at pAg 7.7. Then, 476 ml of an aqueous solution containing 55.4 grams of silver nitrate and an aqueous solution containing 8 μmol/liter of dipotassium hexachloroiridate and 1 mol/liter of potassium bromide were added over 30 minutes by the controlled double jet method while maintaining the solution at pAg 7.7. The pH of the solution was lowered to cause flocculation and sedimentation for desalting. The solution was adjusted to pH 5.9 and pAg 8.0 by adding 0.1 gram of phenoxyethanol. There were obtained cubic grains having a silver iodide content of 8 mol % in the core and 2 mol % on the average, a mean grain size of 0.07 ,m, a coefficient of variation of the projected area diameter of 8%, and a (100) face proportion of 86%.

The thus obtained silver halide grains were heated at 60° C., to which 85 μmol of sodium thiosulfate, 11 μmol of 2,3,4,5,6-pentafluorophenyldiphenylphosphine selenide, 2 μmol of Tellurium compound 1, 3.3 μmol of chloroauric acid, and 230 μmol of thiocyanic acid were added per mol of silver. The solution was ripened for 120 minutes. Thereafter, the temperature was changed to 50° C. and with stirring, $5\times10^{-4}$ mol of Sensitizing dye A and $2\times10^{-4}$ mol of Sensitizing dye B were added, both per mol of the silver halide. Potassium iodide was further added in an amount of 3.5 mol % based on the moles of silver halide. The emulsion was stirred for 30 minutes and then quenched to 30° C., completing the preparation of silver halide grains A.

Sensitizing dyes A and B and Tellurium compound 1 have the following structure.

Sensitizing dye A

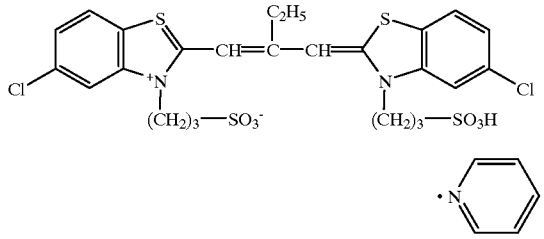

Sensitizing dye B

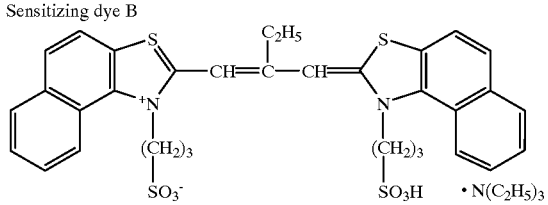

Tellurium compound 1

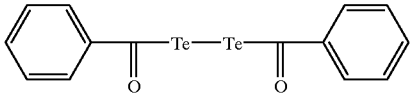

Microcrystalline dispersion of organic acid silver salt

A mixture of 40 grams of behenic acid, 7.3 grams of stearic acid, and 500 ml of distilled water was stirred at 90° C. for 15 minutes. 187 ml of 1N NaOH aqueous solution was added to the solution over 15 minutes and 61 ml of 1N nitric acid aqueous solution was added to the solution, which was cooled to 50° C. Next, 124 ml of 1N silver nitrate aqueous solution was added to the solution over 2 minutes, and agitation was continued for a further 30 minutes. The solids were separated by suction filtration and washed with water until the water filtrate reached a conductivity of 30 $\mu$S/cm. The thus collected solids were handled as wet cake without drying. To an amount of the wet cake corresponding to 34.8 grams of dry solids, 12 grams of polyvinyl alcohol and 150 ml of water were added. A slurry was obtained by thorough agitation. The slurry was admitted into a vessel together with 840 grams of zirconia beads having a mean diameter of 0.5 mm. Dispersion was done for 5 hours by means of a dispersing machine (1/4G sand grinder mill by Imex K.K.), completing the preparation of an organic acid silver microcrystalline dispersion of needle grains having a mean minor diameter of 0.04 $\mu$m, a mean major diameter of 0.8 $\mu$m, and a coefficient of variation of the projected area of 30% as observed under an electron microscope.

Solid particle dispersions of chemical addenda

Solid particle dispersions of tetrachlorophthalic acid, 4-methylphthalic acid, 1,1-bis(2-hydroxy-3,5-dimethylphenyl)-3,5,5-trimethylhexane, phthalazine, and tribromomethylphenylsulfone were prepared.

To 5 grams of tetrachlorophthalic acid were added 0.81 gram of hydroxypropyumethyl cellulose and 94.2 ml of water. They were thoroughly agitated to form a slurry, which was allowed to stand for 10 hours. A vessel was charged with the slurry together with 100 ml of zirconia beads having a mean diameter of 0.5 mm. A dispersing machine as above was operated for 5 hours for dispersion, obtaining a solid particle dispersion of tetrachlorophthalic acid in which particles with a diameter of up to 1.0 $\mu$m accounted for 70% by weight. Solid particle dispersions of the remaining chemical addenda were similarly prepared by properly changing the amount of dispersant and the time of dispersion to achieve a desired mean particle size.

Emulsion layer coating solution

An emulsion layer coating solution was prepared by adding silver halide grains A in an amount of 10 mol % of silver halide based on the moles of organic acid silver, a polymer latex and chemical addenda (shown below) to the above-prepared organic acid silver microcrystalline dispersion (equivalent to 1 mol of silver).

LACSTAR 3307B SBR latex 430 g

Tetrachlorophthalic acid 5 g 1,1-bis(2-hydroxy-3,5-dimethylphenyl)-3,5,5-trimethylhexane 98 g Phthalazine 9.2 g Tribromomethylphenylsulfone 12 g 4-methylphthalic acid 7 g It is noted that the copolymer of LACSTAR 3307B had an equilibrium moisture content of 0.6% by weight at 25° C. and RH 60%.

Emulsion surface protective layer coating solution

A surface protective layer coating solution was prepared by mixing 10 grams of inert gelatin with 0.26 gram of Surfactant A, 0.09 gram of Surfactant B, a matte agent whose type, sphericity, particle size, and amount are shown in Table 7, 0.3 gram of 1,2-bis(vinylsulfonylacetamido)-ethane, and 64 grams of water.

Surfactant A

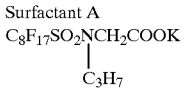

Surfactant B

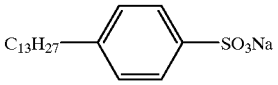

Color developing agent dispersion

To 35 grams of ethyl acetate were added 2.5 grams of Compound 1 and 7.5 grams of Compound 2. The mixture was agitated for dissolution. The solution was combined with 50 grams of a 10 wt % polyvinyl alcohol solution and agitated for 5 minutes by means of a homogenizer. Thereafter, the ethyl acetate was volatilized off for solvent removal purpose. Dilution with water yielded a color developing agent dispersion.

Compound 1

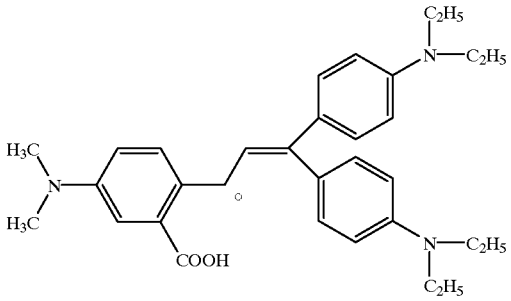

Compound 2

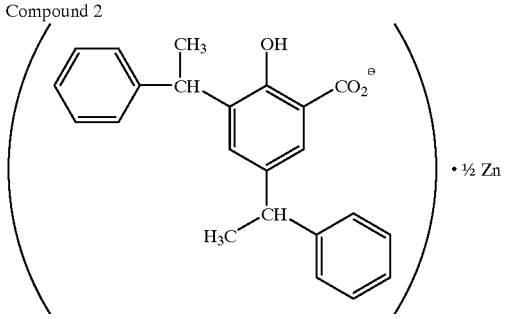

Back surface coating solution

A back surface coating solution was prepared by adding 50 grams of the color developing agent dispersion, 20 grams of Compound 3, 250 grams of water, and a matte agent whose type and amount were the same as in the surface protective layer to 30 grams of polyvinyl alcohol.

Compound 3

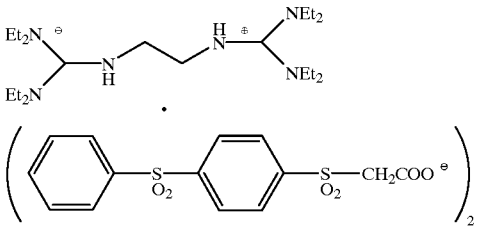

Coated samples

The emulsion layer coating solution prepared above was coated onto a polyethylene terephthalate support of 175 μm thick tinted with a blue dyestuff so as to give a silver coverage of 1.9 g/m$^2$. The emulsion surface protective layer coating solution was coated onto the emulsion coating so as to give a binder coverage of 1.8 g/m$^2$. After drying, the back surface coating solution was coated onto the surface of the support opposite to the emulsion layer so as to give an optical density of 0.7 at 660 nm, obtaining coated sample Nos. 501 to 511.

The samples were stored in an atmosphere of 25° C. and RH 60% for 7 days. Before and after development, the aged samples on the surface were examined for feel to hand touch, haze and Bekk smoothness (second).

The feel of the sample surface to hand touch was rated according to the following 3-rank scale.

A no ragged feel to hand touch

B somewhat ragged touch

C ragged touch

Samples rated "A" and "B" are acceptable as a commercial product.

The development was carried out by pressing the sample at the photosensitive layer side to a heat roller at 120° C. for 25 seconds. Separately, coated samples were exposed, developed and examined for photographic properties. All the samples showed good results with no difference between them.

The results are shown in Table 7.

TABLE 7

| Matte agent in surface protective layer | | | | | |
|---|---|---|---|---|---|
| Sample No. | Type | Material | Mean particle size (μm) | Sphericity | Amount (mg/m$^2$) |
| 501 | — | — | — | — | 0 |
| 502 | Matte agent 1 | PMMA | 5.0 | 1.2 | 50 |
| 503 | Matte agent 1 | PMMA | 5.0 | 1.2 | 10 |
| 504 | Matte agent 1 | PMMA | 3.0 | 1.2 | 50 |
| 505 | Matte agent 2 | silica | 5.0 | 1.5 | 50 |
| 506 | Matte agent 2 | silica | 5.0 | 1.5 | 10 |
| 507 | Matte agent 2 | silica | 3.0 | 1.5 | 50 |
| 508* | Matte agent 3 | silica | 8.5 | 1.0 | 15 |
| 509* | Matte agent 4 | silica | 5.0 | 1.0 | 50 |
| 510* | Matte agent 5 | silica | 3.5 | 1.0 | 70 |
| 510* | Matte agent 6 | silica | 1.2 | 1.0 | 100 |
| 511* | Matte agent 7 | silica | 0.8 | 1.0 | 120 |

| Sample | Haze (%) | | Bekk smoothness (sec.) | | Feel | |
|---|---|---|---|---|---|---|
| No. | Fresh | After processing | Fresh | After processing | Fresh | After processing |
| 501 | 18.8 | 16.3 | 5000 | 5000 | A | A |
| 502 | 22.2 | 18.8 | 1400 | 2500 | A | A |
| 503 | 19.3 | 16.9 | 3500 | 4500 | A | A |
| 504 | 21.1 | 18.3 | 2800 | 4500 | A | A |
| 505 | 22.8 | 20.1 | 1500 | 1400 | C | C |
| 506 | 19.1 | 17.3 | 3200 | 3200 | C | C |
| 507 | 22.6 | 20.8 | 3000 | 3100 | C | C |
| 508* | 20.8 | 18.1 | 800 | 800 | A | A |
| 509* | 22.5 | 19.8 | 1200 | 1200 | A | A |
| 510* | 21.9 | 19.1 | 1800 | 1800 | A | A |
| 510* | 22.5 | 19.8 | 2100 | 2100 | A | A |
| 511* | 22.5 | 18.8 | 2300 | 2300 | A | A |

*preferred embodiment

Matte agent 1: spherical polymethylmethacrylate

Matte agent 2: amorphous silica

Matte agents 3–7: monodisperse spherical silica

The data of Table 7 demonstrate the benefits owing to the addition of the matte agent. That is, samples according to the preferred embodiment of the invention are free of ragged feel to hand touch and the matte agent remains effective even after heat development.

Example 14

Silver halide grains A

In 700 ml of water were dissolved 24 grams of phthalated gelatin and 30 mg of potassium bromide. The solution was adjusted to pH 5.0 at a temperature of 40° C. To the solution, 159 ml of an aqueous solution containing 18.6 grams of silver nitrate and an aqueous solution containing potassium bromide and potassium iodide in a molar ratio of 92:8 were added over 10 minutes by the controlled double jet method while maintaining the solution at pAg 7.6. Then, 476 ml of an aqueous solution containing 55.4 grams of silver nitrate and an aqueous solution containing 8 μmol/liter of dipotassium hexachloroiridate and 1 mol/liter of potassium bromide were added over 30 minutes by the controlled double jet method while maintaining the solution at pAg 7.7. The pH of the solution was lowered to cause flocculation and sedimentation for desalting. The solution was adjusted to pH 5.9 and pAg 8.0 by adding 0.1 gram of phenoxyethanol. There were obtained cubic grains having a silver iodide content of 8 mol % in the core and 2 mol % on the average, a mean grain size of 0.08 μm, a coefficient of variation of the projected area diameter of 8%, and a (100) face proportion of 85%.

The thus obtained silver halide grains were heated as 60° C., to which 85 μmol of sodium thiosulfate, 11 μmol of 2,3,4,5,6-pentafluorophenyldiphenylphosphine selenide, 1.7 μmol of Tellurium compound 1, 3.3 μmol of chloroauric acid, and 210 μmol of thiocyanic acid were added per mol of silver. The solution was ripened for 120 minutes. Thereafter, the temperature was changed to 50° C. and with stirring, $5\times10^{-4}$ mol of Sensitizing dye A and $2\times10^{31\ 4}$ mol of Sensitizing dye B were added, both per mol of the silver halide. Potassium iodide was further added in an amount of 3.5 mol % based on the moles of silver. The emulsion was stirred for 30 minutes and then quenched to 30° C., completing the preparation of silver halide grains A.

Sensitizing dyes A and B and Tellurium compound 1 have the following structure.

Sensitizing dye A

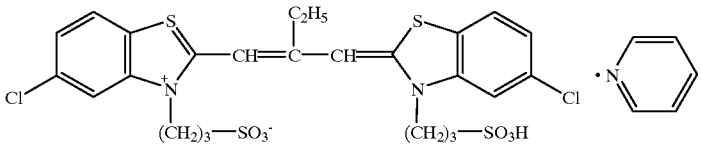

Sensitizing dye B

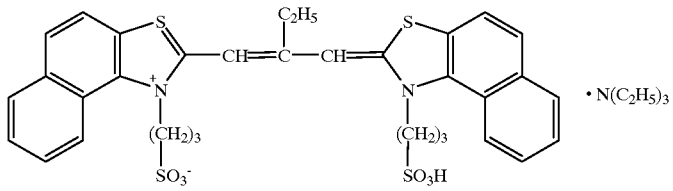

Tellurium compound 1

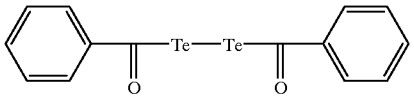

Antifoggant 1

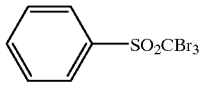

Antifoggant 2

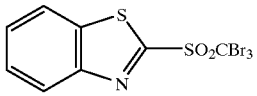

Antifoggant 3

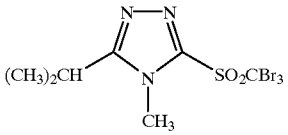

Microcrystalline dispersion of organic acid silver salt

A mixture of 40 grams of behenic acid, 7.1 grams of stearic acid, and 500 ml of distilled water was stirred at 90° C. for 15 minutes. 187 ml of 1N NaOH aqueous solution was added to the solution over 15 minutes and 60 ml of 1N nitric acid aqueous solution was added to the solution, which was cooled to 50° C. Next, 124 ml of 1N silver nitrate aqueous solution was added to the solution over 2 minutes, and agitation was continued for a further 30 minutes. The solids were separated by suction filtration and washed with water until the water filtrate reached a conductivity of 30 $\mu$S/cm. The thus collected solids were handled as wet cake without drying. To an amount of the wet cake corresponding to 33.4 grams of dry solids, 12 grams of polyvinyl alcohol and 150 ml of water were added. A slurry was obtained by thorough agitation. The slurry was admitted into a vessel together with 240 grams of zirconia beads having a mean diameter of 0.5 mm. Dispersion was done for 5 hours by means of a dispersing machine (1/4G sand grinder mill by Imex K.K.), completing the preparation of an organic acid silver microcrystalline dispersion of needle grains having a mean minor diameter of 0.03 $\mu$m, a mean major diameter of 0.9 $\mu$m, and a coefficient of variation of the projected area of 35% as observed under an electron microscope.

Solid particle dispersion of antifoggant

To 3.4 grams of Antifoggant 1 were added 0.54 gram of hydroxypropyl cellulose and 96 grams of water. They were thoroughly agitated into a slurry, which was allowed to stand for 10 hours. A vessel was charged with the slurry along with 168 grams of zirconia beads having a mean diameter of 0.5 mm. A dispersing machine as used above was operated for 10 hours. There was obtained a solid particle dispersion of antifoggant. Those particles having a diameter of 0.4 to 1.0 $\mu$m accounted for 70% by weight of the dispersed particles.

Solid particle dispersions were similarly prepared from Antifoggants 2 and 3, respectively. The particle size distribution was the same as above.

Solid particle dispersion of reducing agent

A solid particle dispersion of reducing agent was prepared by the same procedure as the preparation of the antifoggant solid particle dispersion, by adding 10 grams of 1,1-bis(2-hydroxy-3,5-dimethylphenyl)-3,5,5-trimethylhexane, designated Reducing agent 1, and 4 grams of hydroxypropyl cellulose to 86 ml of water and thoroughly agitating them into a slurry. Those particles having a diameter of 0.3 to 1.0 $\mu$m accounted for 80% by weight of the dispersed particles.

Solid Particle dispersion of toner

To 93 grams of water were added 2.9 grams of 4-methylphthalic acid, 2.1 grams of phthalazine, and 2 grams of hydroxypropyl cellulose. They were thoroughly agitated into a slurry, which was allowed to stand for 10 hours. A vessel was charged with the slurry along with 168 grams of zirconia beads having a mean diameter of 0.5 mm. A dispersing machine as used above was operated for 10 hours. There was obtained a solid particle dispersion of toner. Those particles having a diameter of 0.3 to 1.0 $\mu$m accounted for 60% by weight of the dispersed particles.

Emulsion layer coating solution

An emulsion coating solution was prepared by adding silver halide grains A in an amount of 10 mol % of silver halide based on the moles of organic acid silver, a polymer latex and chemical addenda (shown below) to the above-prepared organic acid silver microcrystalline dispersion (equivalent to 1 mol of silver).

LACSTAR 3307B SBR latex 430 g 4-methylphthalic acid 9.2 g

Phthalazine 6.7 g

Antifoggant (see Table 8) 10 g

Reducing agent 1 90 g

All chemical addenda: 4-methylphthalic acid, phthalazine, antifoggant, and reducing agent were added as a solid particle dispersion.

Coated sample No. 601 used inert gelatin instead of the polymer latex, coated sample Nos. 602 and 603 used polyvinyl alcohol instead of the polymer latex, and coated sample No. 614 used LACSTAR DS206 as the polymer latex, all in the same amount. Note that LACSTAR 3307B and DS206 are polymer latices of a styrene-butadiene copolymer whose dispersed particles have a mean particle size of about 0.1 to 0.15 $\mu$m.

Emulsion surface protective layer coating solution

A surface protective layer coating solution was prepared by mixing 10 grams of inert gelatin with 0.26 gram of Surfactant A, 0.09 gram of Surfactant B, 1.0 gram of silica particles with a mean particle size of 2.5 $\mu$m, 0.4 gram of 1,2-bis(vinylsulfonylacetamido)ethane, and 66 grams of water.

Surfactant A

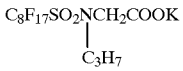

Surfactant B

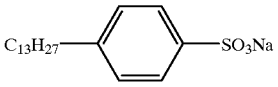

Color developing agent dispersion

To 35 grams of ethyl acetate were added 2.5 grams of Compound 1 and 7.5 grams of Compound 2. The mixture was agitated for dissolution. The solution was combined with 50 grams of a 10 wt % polyvinyl alcohol solution and agitated for 5 minutes by means of a homogenizer. Thereafter, the ethyl acetate was volatilized off for solvent removal purpose. Dilution with water yielded a color developing agent dispersion.

Compound 1

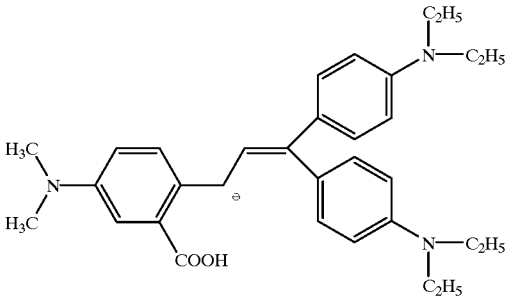

Compound 2

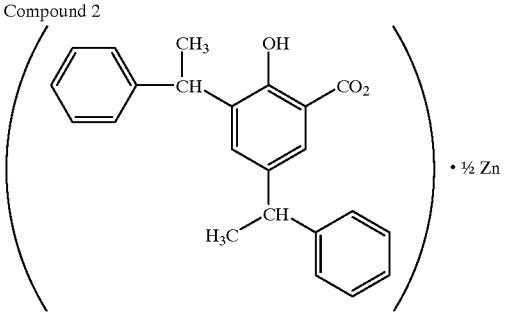

Back surface coating solution

A back surface coating solution was prepared by adding 51 grams of the color developing agent dispersion, 20 grams of Compound 3, 250 grams of water, and 2.0 grams of Sildex H121 spherical silica having a mean particle size of 12 $\mu$m 15 to 30 grams of polyvinyl alcohol.

Compound 3

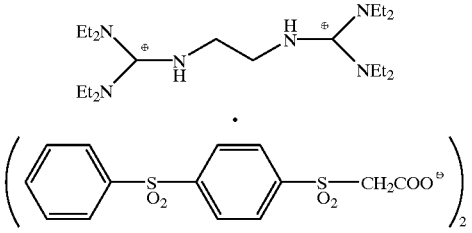

Coated sample Nos. 601 to 614

The emulsion layer coating solution prepared above was coated onto a polyethylene terephthalate support of 175 $\mu$m thick tinted with a blue dyestuff so as to give a silver coverage of 1.8 g/m$^2$. The emulsion surface protective layer coating solution was simultaneously coated onto the emulsion coating so as to give a binder coverage of 1.8 g/m$^2$. After drying, the back surface coating solution was coated onto the surface of the support opposite to the emulsion layer so as to give an optical density of 0.7 at 660 nm, obtaining coated sample Nos. 601 to 614.

Coated sample No. 615

To 300 ml of water was added 10.6 grams of behenic acid. The mixture was heated at 90° C. for dissolution. With thorough stirring, 31.2 ml of 1N sodium hydroxide was added to the solution, which was allowed to stand for one hour at the temperature. The solution was then cooled to 30° C., to which 7.0 ml of 1N phosphoric acid was added. With thorough stirring, 0.01 gram of N-bromosuccinimide was added to the solution. Thereafter, while the solution was heated at 40° C. and stirred, the silver halide grains A prepared above were added to the solution so as to give 10 mol % of silver based on the moles of behenic acid. Further, 25 ml of an aqueous solution of 1N silver nitrate was continuously added over 2 minutes to the solution, which was stirred for a further one hour. With stirring, 37 grams of a n-butyl acetate solution of 1.2 wt % polyvinyl acetate was gradually added to the solution to form flocs in the dispersion. Water was removed, and water washing was repeated twice. 20 ml of a solution of 2.5% by weight polyvinyl butyral in 2-butanone was added and stirring was continued. Then 40 grams of 2-butanone and 6.0 grams of polyvinyl butyral were added to the dispersion. Stirring was continued for one hour, yielding an organic silver salt emulsion. To the emulsion, solutions of the same chemical addenda as used in coated sample No. 601 in organic solvents such as methanol, 1-butanone and dimethylformamide were added. This solution was coated on a polyethylene terephthalate support of 175 μm thick tinted with a blue dyestuff so as o give a silver coverage of 1.8 g/m$^2$. A protective layer coating solution was prepared by mixing 7.5 grams of cellulose acetate butyrate, 80 grams of 2-butanone, and 10 grams of methanol and coated on the emulsion layer in such an amount as to give 2.5 g/m$^2$ of cellulose acetate butyrate. Back surface coating was the same as in coated sample No. 601. A coated sample No. 615 was obtained in this way.

For sample Nos. 601 to 615, the binders used in their photosensitive layer were measured for equilibrium moisture content. The samples were examined for photographic properties, natural aging stability, coating surface quality and silver tone by the following methods.

Measurement of moisture content of binder

A solution or dispersion of the polymer used in the emulsion layer was coated on a glass plate and dried at 50° C. for one hour to form a model polymer film of 100 μm thick. When two or more polymers were used as a binder in the layer, a sample was prepared by mixing these polymers in the same ratio as in that layer. The model polymer film was stripped from the glass plate and allowed to stand at 25° C. and RH 60% for 3 days before its weight (W1) was measured. The model polymer film was then allowed to stand in vacuum for 3 days. Immediately thereafter, the film was placed in a weighing bottle having a known weight (W2). From the weight (W3) of the bottle, the weight of the dry polymer film was calculated (W0=W3−W2). The equilibrium moisture content (Weq) at 25° C. and RH 60% of the polymer was calculated according to the equation: Wea=(W1−W0)W0×100% by weight.

Photographic properties

A coated sample was exposed at an incident angle of 30° by means of a laser sensitometer equipped with a 647-nm Kr laser (maximum power 500 mW) and developed at 120° C. for 20 seconds. The image was examined for Dmin and sensitivity by a densitometer. The sensitivity (S) is the reciprocal of a ratio of an exposure providing a density higher by 1.0 than Dmin and expressed in a relative value based on a sensitivity of 100 for coated sample No. 615.

Natural aging stability

A coated sample was cut into sections of 30.5 cm×25.4 cm with round corners having an inner radius of 0.5 cm. The sample sheet was kept in an atmosphere of 25° C. and RH 50% for one day. Each sample sheet was placed in a moisture-proof bag, which was sealed and placed in a decorative box of 35.1 cm×26.9 cm×3.0 cm. In this condition, the sheet was aged for 5 days at 50° C. (forced aging test). The aged sheet was processed as in the photographic test and measured for Dmin.

Coating surface quality

A coated sample was visually observed and rated "○" when the surface quality was practically acceptable and "X" when the surface quality was poor and practically unacceptable.

Silver tone

A coated sample was processed as in the photographic test and the tone of a maximum density area was evaluated.

The results are shown in Table 8.

TABLE 8

| Coated sample | Main binder | Moisture content (wt %) | Ease of coating | Anti-foggant | Antifoggant adding manner |
|---|---|---|---|---|---|
| 601 | gelatin | 10.0 | easy | 1 | methanol solution |
| 602 | polyvinyl alcohol | 4.0 | easy | 1 | methanol solution |
| 603 | polyvinyl alcohol | 4.0 | easy | 1 | solid particle dispersion |
| 604 | LACSTAR 3307B | 0.6 | easy | 1 | methanol solution |
| 605 | LACSTAR 3307B | 0.6 | easy | — | — |
| 606 | LACSTAR 3307B | 0.6 | easy | 1 | dimethyl-formamide solution |
| 607* | LACSTAR 3307B | 0.6 | easy | 1 | solid particle dispersion |
| 608 | LACSTAR 3307B | 0.6 | easy | 2 | methanol solution |
| 609 | LACSTAR 3307B | 0.6 | easy | 2 | dimethyl-formamide solution |
| 610* | LACSTAR 3307B | 0.6 | easy | 2 | solid particle dispersion |
| 611 | LACSTAR 3307B | 0.6 | easy | 3 | methanol solution |
| 612 | LACSTAR 3307B | 0.6 | easy | 3 | dimethyl-formamide solution |
| 613* | LACSTAR 3307B | 0.6 | easy | 3 | solid particle dispersion |
| 614* | LACSTAR DS206 | 0.4 | easy | 3 | solid particle dispersion |
| 615 | polyvinyl butyral | 1.0 | difficult | 3 | methanol solution |

| Coated | Photographic properties | | Natural aging | Silver | Coating |
|---|---|---|---|---|---|
| sample | D min. | S | stability, D min. | tone | surface quality |
| 601 | 0.18 | 15 | 0.57 | brown | X |
| 602 | 0.15 | 90 | 0.31 | brown | X |
| 603 | 0.12 | 98 | 0.35 | brown | ○ |
| 604 | 0.13 | 100 | 0.16 | black | X |
| 605 | 0.85 | 83 | 1.78 | black | ○ |
| 606 | 0.21 | 101 | 0.30 | black | X |
| 607* | 0.07 | 110 | 0.09 | black | ○ |
| 608 | 0.12 | 106 | 0.13 | black | X |
| 609 | 0.23 | 101 | 0.34 | black | X |
| 610* | 0.07 | 110 | 0.09 | black | ○ |
| 611 | 0.11 | 105 | 0.14 | black | X |
| 612 | 0.24 | 105 | 0.38 | black | X |
| 613* | 0.07 | 111 | 0.08 | black | ○ |
| 614* | 0.07 | 108 | 0.09 | black | ○ |
| 615 | 0.09 | 100 | 0.18 | black | ○ |

*preferred embodiment

As is evident from Table 8, coated samples containing an antifoggant added in the form of a solid particle dispersion and a polymer latex as the binder show black silver tone, good coating surface quality, satisfactory photographic properties, and natural aging stability. The coating solutions are easy to handle as compared with sample No. 615.

Example 15

Coated samples were prepared and examined as in Example 14 except for the following changes. Silver halide grains A were replaced by silver halide grains B which were prepared by the same procedure as silver halide grains A in Example 14 except that Sensitizing dyes C and D (shown below) were used instead of Sensitizing dyes A and B.

Sensitizing dye C

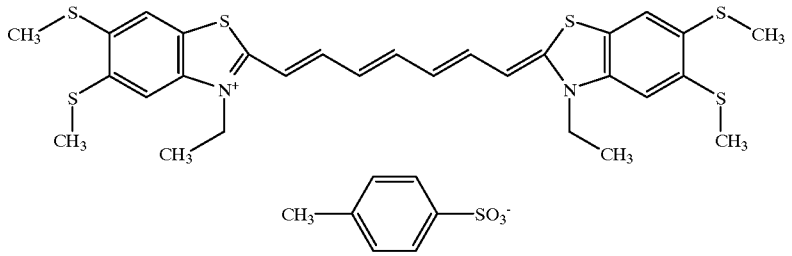

Sensitizing dye D

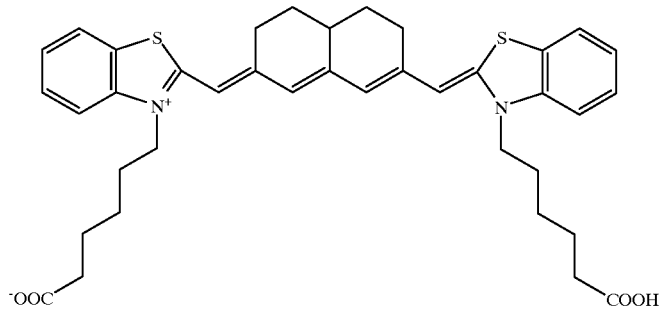

The coated samples were examined for photographic properties and natural aging stability as in Example 14, using a laser sensitometer equipped with a 820-nm diode instead of the sensitometer used in Example 14.

The samples showed the same results as in Example 14, demonstrating the benefits owing to the addition of the antifoggant as a solid particle dispersion and the use of a polymer latex.

There has been described a photothermographic material comprising a microparticulate organic silver salt and a polymer latex as a main binder. The salt and other components are typically added as a solid particle dispersion. Layers are typically formed by coating a coating solution of components in an aqueous solvent. The resulting photothermographic material is improved in coating surface quality and silver tone. The formation of a photosensitive layer using a coating solution in an aqueous solvent is advantageous because there is no need to use organic solvents which are detrimental to the environment and human body and expensive. In several preferred embodiments, photographic properties, natural aging stability and water resistance are improved. In a further embodiment, a matte agent continues to be effective even after development.

Reasonable modifications and variations are possible from the foregoing disclosure without departing from either the spirit or scope of the present invention as defined by the claims.

What is claimed is:

1. A method for preparing a photothermographic element comprising applying a coating solution containing a photosensitive silver halide, an organic silver salt, a reducing agent, and a binder in a solvent onto a support to form a photosensitive layer, wherein (i) said organic silver salt, in the form of solid microparticulates having a mean particle size of from 0.05 to 10.0 $\mu$m, is a silver salt of an organic carboxylic acid, (ii) at least 70% by weight of the solvent is water, (iii) said coating solution contains a polymer as the binder wherein at least 50% by weight of the polymer is present in polymer latex form, (iv) said organic silver salt and said reducing agent are in the form of solid particle dispersions in the polymer latex in said coating solution, and (v) said photothermographic element further comprises a toner and an organic halide as an antifoggant, wherein said toner and said antifoggant are applied to the element using coating solutions containing said toner and said antifoggant in solid microparticulate form.

2. The method of claim 1 wherein the polymer has an equilibrium moisture content of up to 2% by weight at 25° C. and RH 60%.

3. The method of claim 1, wherein the toner is present in a layer which has been formed using a solid particle dispersion of the toner and a polymer latex as a main binder.

4. The method of claim 1, wherein the antifoggant is present in a layer which has been formed using a solid particle dispersion of the antifoggant and a polymer latex.

5. The method of claim 4 wherein the layer containing the antifoggant has been formed by coating a coating solution of the antifoggant in a solvent containing at least 30% by weight of water, followed by drying.

6. The method of claim 4 wherein the antifoggant in solid microparticulate form and the photo-sensitive silver halide are contained in a common layer.

7. The method of claim 1 further comprising a surface protective layer which has been crosslinked with a crosslinking agent.

8. The method of claim 1, wherein the photothermographic element further comprises a surface protective layer on the photosensitive layer, and at least one non-photosensitive layer between the photosensitive layer and the surface protective layer.

9. The method of claim 8 wherein said non-photosensitive layer has been formed using a polymer latex or hydrophilic polymer as a binder in an amount to account for at least 50% by weight of the binder.

10. The method of claim 8 wherein said surface protective layer contains a binder composed of at least 30% by weight of a hydrophilic polymer.

11. The method of claim 10 wherein the hydrophilic polymer is gelatin.

12. The method of claim 1 further comprising at least one layer containing a matte agent of spherical silica on at least one surface of the support.

13. The method of claim 1, wherein the organic silver salt is contained in an amount of 5 to 30% by weight of the organic silver salt-containing layer.

14. The method of claim 1, wherein the reducing agent is contained in an amount of 6 to 60 mol % of the organic silver salt.

15. The method of claim 1, wherein the reducing agent, the toner, and the antifoggant form solid dispersions having a particle size of 0.005 to 10 $\mu$m.

16. The method of claim 1, wherein the toner is contained in an amount of 0.1 to 10% by weight of the entire silver quantity.

17. The method of claim 19, wherein the antifoggant is contained in an amount of 0.05 to 1,000 mg per square meter of the photothermographic element.

18. The method of claim 1, wherein the toner in solid particle dispersion form and the antifoggant in solid particle dispersion form are contained in the coating solution for the photosensitive layer.

19. A method for preparing a photothermographic element comprising applying a coating solution containing a photosensitive silver halide, an organic silver salt, a reducing agent, and a binder in a solvent onto a support to form a photosensitive layer, wherein (i) said organic silver salt, in the form of solid microparticulates having a mean particle size of from 0.05 to 10.0 $\mu$m, is a silver salt of an organic carboxylic acid, (ii) at least 70% by weight of the solvent is water, (iii) said coating solution contains a polymer as the binder wherein at least 50% by weight of the polymer is present in polymer latex form, (iv) said organic silver salt and said reducing agent are in the form of solid particle dispersions in the polymer latex in said coating solution, and (v) said photothermographic element further comprises at least two toners and an organic halide as an antifoggant, wherein said toners and said antifoggant are applied to the element using coating solutions containing said toners and said antifoggant in solid microparticulate form.

20. The method of claim 19, wherein said at least two toners are present in a layer which has been formed using a solid particle dispersion prepared by simultaneously dispersing said at least two toners.

* * * * *